US011004427B2

(12) United States Patent
Croxford et al.

(10) Patent No.: US 11,004,427 B2
(45) Date of Patent: May 11, 2021

(54) METHOD OF AND DATA PROCESSING SYSTEM FOR PROVIDING AN OUTPUT SURFACE

(71) Applicant: Arm Limited, Cambridge (GB)

(72) Inventors: Daren Croxford, Cambridge (GB); Sharjeel Saeed, Cambridge (GB)

(73) Assignee: Arm Limited, Cambridge (GB)

( * ) Notice: Subject to any disclaimer, the term of this patent is extended or adjusted under 35 U.S.C. 154(b) by 0 days.

(21) Appl. No.: 16/009,692

(22) Filed: Jun. 15, 2018

(65) Prior Publication Data

US 2019/0027120 A1 Jan. 24, 2019

(30) Foreign Application Priority Data

Jul. 24, 2017 (GB) ..... 1711896

(51) Int. Cl.
*G09G 5/391* (2006.01)
*G09G 3/00* (2006.01)
*G09G 5/397* (2006.01)

(52) U.S. Cl.
CPC ..... *G09G 5/391* (2013.01); *G09G 3/001* (2013.01); *G09G 3/003* (2013.01); *G09G 5/397* (2013.01);
(Continued)

(58) Field of Classification Search
CPC .. G06T 19/006; H04N 5/23238; G09G 5/391; G09G 5/397; G09G 3/001; G09G 3/003;
(Continued)

(56) References Cited

U.S. PATENT DOCUMENTS 4,028,725 A 6/1977 Lewis
6,078,427 A 6/2000 Fontaine et al.
(Continued)

FOREIGN PATENT DOCUMENTS

EP 2919098 9/2015
EP 3021285 5/2016
(Continued)

OTHER PUBLICATIONS

GB Search Report dated Jan. 18, 2018, GB Patent Application GB1711896.9.
(Continued)

*Primary Examiner* — Daniel F Hajnik
(74) *Attorney, Agent, or Firm* — Vierra Magen Marcus LLP

(57) ABSTRACT

A data processing system for providing an output surface for display. The data processing system includes rendering circuitry operable to generate one or more input surfaces to be used for providing an output surface for display. The rendering circuitry is operable to generate a peripheral region of an input surface at a lower fidelity than the fidelity at which a central region of the input surface is generated or is operable to generate one of a plurality of input surfaces at a lower fidelity than the fidelity at which another of the plurality of input surfaces is generated. The data processing system also includes display composition circuitry operable to select part of at least one of the one or more generated input surfaces based on received view orientation data to provide an output surface for display.

17 Claims, 19 Drawing Sheets

(52) U.S. Cl.
CPC ..... *G09G 2310/0232* (2013.01); *G09G 2340/0407* (2013.01); *G09G 2340/0435* (2013.01); *G09G 2350/00* (2013.01); *G09G 2352/00* (2013.01); *G09G 2354/00* (2013.01); *G09G 2360/08* (2013.01); *G09G 2360/18* (2013.01)

(58) Field of Classification Search
CPC ... G09G 2310/0232; G09G 2340/0407; G09G 2340/0435; G09G 2350/00; G09G 2352/00; G09G 2354/00; G09G 2360/08; G09G 2360/18
See application file for complete search history.

(56) References Cited

U.S. PATENT DOCUMENTS

| | | | | |
|---|---|---|---|---|
| 6,252,989 | B1 | 6/2001 | Geisler et al. | |
| 8,542,939 | B2 | 9/2013 | Nystad | |
| 8,990,518 | B2 | 3/2015 | Nystad | |
| 9,014,496 | B2 | 4/2015 | Nystad | |
| 9,116,790 | B2 | 8/2015 | Nystad | |
| 9,491,490 | B1 * | 11/2016 | Toth | H04N 19/115 |
| 2003/0198393 | A1 | 10/2003 | Berstis | |
| 2006/0271612 | A1 | 11/2006 | Ritter | |
| 2014/0247277 | A1 * | 9/2014 | Guenter | G06T 11/40 345/611 |
| 2014/0361977 | A1 | 12/2014 | Stafford et al. | |
| 2016/0012855 | A1 * | 1/2016 | Krishnan | G11B 27/105 386/241 |
| 2017/0018121 | A1 * | 1/2017 | Lawson | G06T 3/0093 |
| 2018/0007422 | A1 * | 1/2018 | Castleman | H04N 21/441 |
| 2018/0286105 | A1 * | 10/2018 | Surti | G02B 27/017 |

FOREIGN PATENT DOCUMENTS

| | | | |
|---|---|---|---|
| EP | 3168739 | A1 | 5/2017 |
| EP | 3236306 | | 10/2017 |
| GB | 2548860 | | 10/2017 |
| WO | 2006/106371 | | 10/2006 |
| WO | 2009131626 | A2 | 10/2009 |

OTHER PUBLICATIONS

Michael Antonov, "Asynchronous Timewarp Examined," Mar. 2, 2015, Retrieved from the Internet: https://developer.oculus.com/blog/asynchronous-timewarp-examined/.
GB Search Report dated Sep. 3, 2018 (relevant to claims 8 & 19, 23-24), GB Patent Application GB1711896.9.
GB Search Report dated Sep. 3, 2018 (relevant to claims 10-11, 21-24), GB Patent Application GB1711896.9.
GB-1711896.9—Examination Report dated Mar. 9, 2020, 2 pages.

* cited by examiner

METHOD OF AND DATA PROCESSING SYSTEM FOR PROVIDING AN OUTPUT SURFACE

BACKGROUND

The technology described herein relates to a method of and a data processing system for providing an output surface for display in a data processing system, in particular for providing an output surface for display in a virtual reality head-mounted display system.

When rendering images (frames) for a virtual reality display, e.g. for use in a head mounted display system, the appropriate frames to be displayed to each eye are typically rendered by a graphics processing unit (GPU), for example. Such frames are typically rendered in response to appropriate commands and data from an application, such as a game (e.g. executing on a central processing unit (CPU)), that requires the virtual reality display. The GPU will, for example, render the frames that are to be displayed at a frame rate such as 30 frames per second (and will render both a left and right eye view at that rate).

In such arrangements, the system will also operate to track the movement of the head and/or the gaze of the user (so-called head pose tracking). This head orientation (pose) data is then used to determine how the images should actually be displayed to the user for their current head position (view direction), and the images (frames) are rendered accordingly (for example by setting the camera (viewpoint) orientation based on the head orientation data), so that an appropriate image based on the user's current direction of view can be displayed.

To account for this head motion of a user, a process known as "time-warp" has been proposed for virtual reality head-mounted display systems. In this process, the frames to be displayed are rendered based on the head orientation data sensed at the beginning of the rendering of the frames, but then before the frames are actually displayed, further head orientation (pose) data is sensed, and that updated head pose sensor data is then used to render an "updated" version of the original frame that takes account of the updated head orientation (pose) data. The "updated" version of the frame is then displayed. This allows the image displayed on the display to more closely match the user's latest head orientation.

To do this processing, the initial, "application" frames are rendered by the GPU into appropriate buffers in memory, but there is then a second rendering process that takes the initial, application frames in memory and uses the latest head orientation (pose) data to render versions of the initially rendered frames that take account of the latest head orientation to provide the frames that will be displayed to the user. This typically involves performing some form of transformation on the initial frames, based on the head orientation (pose) data. The so-called "time-warp" rendered frames that are actually to be displayed are written into a further buffer or buffers in memory, from where they are then read out for display by the display controller. In order to provide a smoother virtual reality display, the time-warp processing may be performed at a higher frame rate (e.g. 90 or 120 frames per second) than the frame rate (e.g. 30 frames per second) at which the initial, application frames are rendered by the GPU.

The Applicants believe that there is scope for improved arrangements for performing "time-warp" rendering for virtual reality displays in data processing systems.

BRIEF DESCRIPTION OF THE DRAWINGS

A number of embodiments of the technology described herein will now be described by way of example only and with reference to the accompanying drawings, in which.

DETAILED DESCRIPTION

Figure 1:
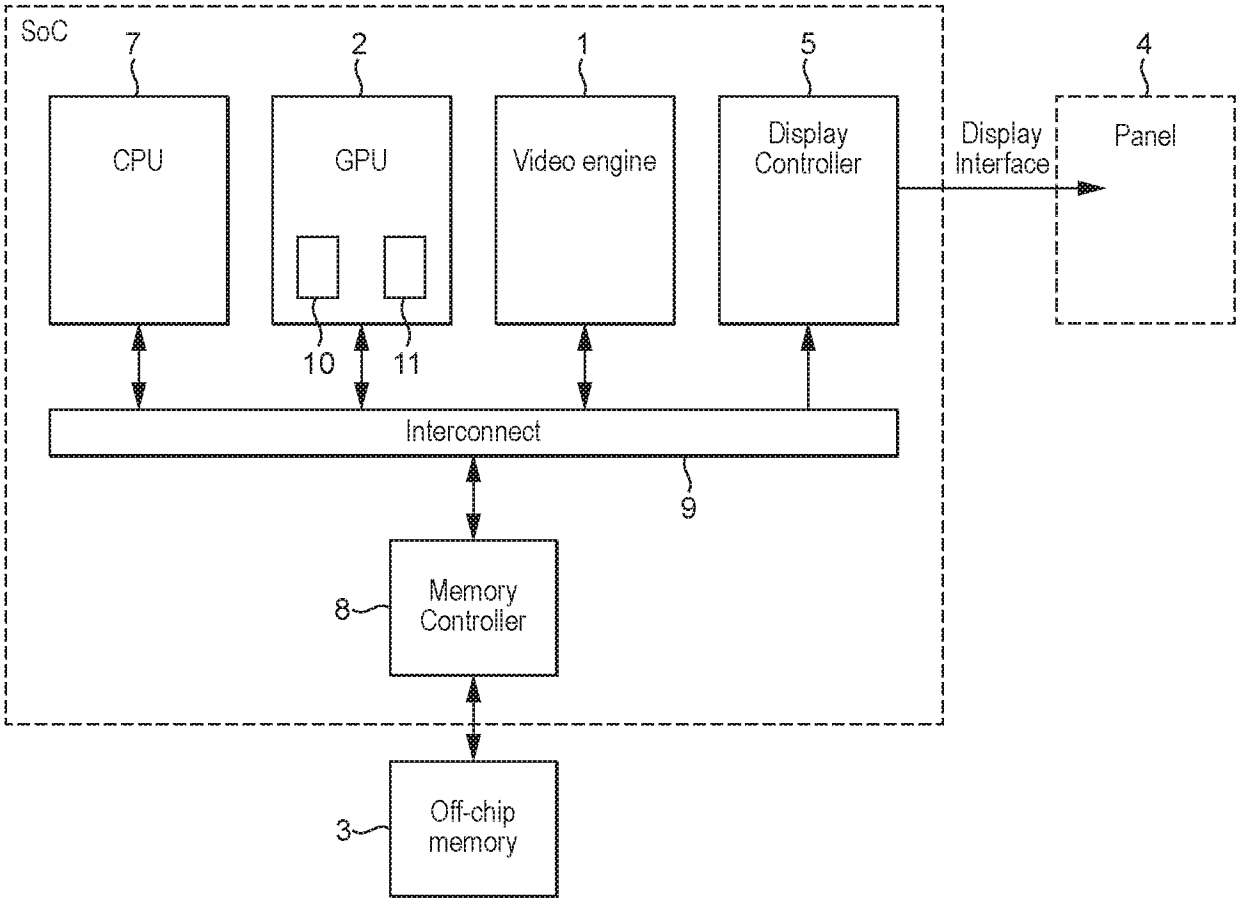
FIG. 1 shows schematically an exemplary data processing system.

An embodiment of the technology described herein comprises a method of providing an output surface for display, the method comprising:

generating one or more input surfaces to be used for providing an output surface for display, wherein the step of generating one or more input surfaces comprises generating a peripheral region of an input surface at a lower fidelity than the fidelity at which a central region of the input surface is generated and/or generating one of a plurality of input surfaces at a lower fidelity than the fidelity at which another of the plurality of input surfaces is generated; and selecting part of at least one of the one or more generated input surfaces based on received view orientation data to provide an output surface for display.

Another embodiment of the technology described herein comprises a data processing system for providing an output surface for display, the data processing system comprising:

rendering circuitry operable to generate one or more input surfaces to be used for providing an output surface for display, wherein the rendering circuitry is operable to generate a peripheral region of an input surface at a lower fidelity than the fidelity at which a central region of the input surface is generated and/or to generate one of a plurality of input surfaces at a lower fidelity than the fidelity at which another of the plurality of input surfaces is generated; and display composition circuitry operable to select part of at least one of the one or more generated input surfaces based on received view orientation data to provide an output surface for display.

The technology described herein relates to a method of providing an output surface (e.g. frame) for display and a data processing system that is operable to provide an output surface (frame) for display to a display. As with conventional display systems that use a time-warp process which depends upon head pose tracking to provide an output surface for display, the method and data processing system of the technology described herein generates (e.g. renders) an input surface (e.g. frame) that is used to provide such an output surface. The input surface typically represents (i.e. is generated over) a wide field of view based, for example, on a permitted or expected amount of head motion in the time period that an input surface is supposed to be valid for.

Then, when the input surface is to be displayed, the, e.g., time-warp process will be used to display an updated version of the input surface as the output surface based on more recent received view orientation data, e.g. from a virtual reality or augmented reality headset. The method and data processing system of the technology described herein selects part (e.g. an appropriate window ("letterbox")) of the input surface(s) to form the output surface based on the received view orientation data to provide the actual output image surface that is displayed to the user.

However, in contrast with convention display systems, the method and data processing system of the technology described herein either generates an input surface that has a periphery which is generated at a lower fidelity (e.g. quality and/or resolution) than the centre of the input surface, and/or generates multiple input surfaces with one of the input surfaces being generated at a lower fidelity. Part of at least one of the one or more input surfaces generated is then selected based on received view orientation data (e.g. head position (pose) (tracking) information) to form the output surface for display.

The Applicants have appreciated that in conventional systems, using an input surface to provide an output surface based on head pose tracking (e.g. in a time-warp process) may be potentially memory bandwidth and power intensive. This is because the input surface (which will typically have been rendered at a high resolution) will need to be read and "time-warped" at a relatively high frame rate. This can lead to large memory transactions, and large memory and bus bandwidth use.

However, the Applicants have recognised that by generating either the edges of an input surface or a version of an input surface at a lower fidelity for use when composing an output surface, it may be possible (e.g. when a large head movement in a small space of time has been detected) to display a lower quality version of parts of the input surface, e.g. around the edges of the output surface. This is because large head movements in a small space of time can result in viewing the edges of the input surface. However, owing to the viewer moving their head relatively rapidly in such circumstances, they will generally not be able to see the image in as much detail. Furthermore, owing to the nature of the (barrel) distortion that is produced by virtual reality headsets, the edges of the frame may be distorted in any event, and so again a lower quality display of those edges may be acceptable to users.

The technology described herein therefore exploits this, by providing the ability to select a part or a version of an input surface having a lower fidelity (depending on the received view orientation data) for use in the output surface, such that in a time-warp process, for example, the output surface for display may be able to be formed from lower fidelity parts or versions of the input surface(s), e.g. towards its edges where this reduction in quality may not be noticeable to a user. This then has the effect of allowing these parts of the output surface that is displayed to consume less memory bandwidth, etc., e.g. when reading, time-warping and writing out the input and output surfaces.

The one or more input surfaces that the rendering circuitry generates may be any suitable and desired such surfaces. In an embodiment, the one or more input surfaces are one or more input surfaces that are intended to be used in the generation of an output surface (or output surfaces) to be displayed on a display that the display composition circuitry is associated with. In an embodiment, (e.g. each of) the one or more input surfaces is an image, e.g. frame, for display.

In an embodiment, the one or more input surfaces that are used as the basis from which an output surface is selected (from part of the input surface) comprise one or more frames generated for display for an application, such as a game, but which are to be displayed based on a determined view orientation after they have been initially rendered (e.g. which is to be subjected to "time-warp" processing).

The one or more input surfaces (and each input surface) may comprise an array of data elements (sampling positions) (e.g. pixels), for each of which appropriate data (e.g. a set of colour values) is stored.

The data elements (e.g. pixels) may be grouped together (and processed as such) in blocks of plural data elements. Thus, in an embodiment, the data elements of an input surface or surfaces are grouped together and processed in blocks of plural data elements. In an embodiment, the data elements of an output surface are grouped together and processed in blocks of plural data elements.

The blocks (areas) of the input surface in this regard may be any suitable and desired blocks (areas) of the input surface. In an embodiment each block comprises an (two dimensional) array of defined sampling (data) positions (data elements) of the input surface and extends by plural sampling positions (data elements) in each axis direction. In an embodiment the blocks are rectangular, e.g. square. The blocks may, for example, each comprise 4×4, 8×8 or 16×16 sampling positions (data elements) of the input surface.

In an embodiment, at least one of the one or more input surfaces are generated over a larger field of view (e.g. a greater area) than the output surface for display, particularly when multiple successive output surfaces are selected from the same one or more input surfaces. This helps to accommodate (e.g. reasonable amounts of) head movement in the time period between an input surface being generated and an output surface (or surfaces) being selected, e.g. before the subsequent input surface is generated. The expected head movement (and thus the size of the one or more input surfaces generated) may depend on the application, e.g. on the type of images being drawn.

The one or more input surfaces may be generated as desired.

The one or more input surfaces are generated (rendered) by the rendering circuitry, e.g. by a graphics processing unit (a graphics processor) of the data processing system that the display composition circuitry is part of, but they could also or instead be generated or provided by another component or components of the overall data processing system, such as a CPU or a video processor, when desired. In an embodiment, the rendering circuitry generates the one or more input surfaces in response to appropriate commands and data from an application, such as a game (e.g. executing on a central processing unit (CPU)) that requires the display.

As well as the output surface(s) being selected based on received view orientation data, in an embodiment the one or more input surfaces are generated based on received view orientation data. Thus, for example, when (e.g. each time) the one or more input surfaces are generated (by the rendering circuitry), the received view orientation data (e.g. at that time) is used to generate the one or more input surfaces, e.g. such that the application draws the one or more input surfaces appropriately based on the received view orientation data.

In an embodiment the generated one or more input surfaces are stored, e.g. in a frame buffer, in memory, from where they are then read by the display composition circuitry for generating an output surface. Thus, in an embodiment, the method comprises (and the rendering circuitry is operable to) writing out the one or more input surfaces, e.g. to a (e.g. frame buffer in a) memory. In an embodiment, the method comprises (and the display composition circuitry is operable to) reading the one or more input surfaces (e.g. from the (e.g. frame buffer in the) memory) for use in providing an output surface for display.

The memory where the one or more input surfaces are stored may comprise any suitable memory and may be configured in any suitable and desired manner. For example, it may be a memory that is on-chip with the rendering circuitry and/or the display composition circuitry or it may be an external memory. In an embodiment, it is an external memory, such as a main memory of the overall data processing system. It may be dedicated memory for this purpose or it may be part of a memory that is used for other data as well. In an embodiment, the one or more input surfaces are stored in (and read from) a frame buffer (e.g. an "eye" buffer).

The one or more input surfaces to be used for providing (e.g. composing) an output surface for display may be generated in any suitable and desired way. In one embodiment (e.g. only) a single input surface is generated, with the input surface being generated at a lower fidelity around its periphery than at its centre.

Owing to an output surface subsequently being selected from part (i.e. not all) of an input surface having a lower fidelity peripheral region, in this embodiment the lower fidelity periphery may, for example, only be selected to form part of an output surface when the received view orientation data indicates a large head movement in a small space of time. In such circumstances the viewer will generally not be able to see the image in as much detail (owing to the speed of their head movement) and so the lower fidelity parts of the input surface that may be selected to form at least part of an output surface may be acceptable to the viewer.

Conversely, when the received view orientation data indicates that there is little or no head movement, the part of an input surface selected to form an output surface may be selected wholly or predominantly from the higher fidelity central region of the input surface, e.g. depending on the relative sizes of the peripheral and central regions of the input surface. This then helps to provide a higher quality display when the viewer's head movement is limited and they would be able to discern any significant reduction in quality.

The peripheral region (which is generated at a lower fidelity) may be any suitable and desired size and/or, e.g. compared to the size and/or shape of the central region. The size and/or shape of the peripheral region may depend on the expected amount of head movement, which may in turn depend on the application and the type of images being drawn. It will be appreciated that the specific application may influence the likelihood of the user making large head movements.

Thus, for example, when it is unlikely that a user will perform a large enough head movement to see the peripheral region, the fidelity (e.g. resolution) of the peripheral region may be reduced and/or the size of the peripheral region may be increased without reducing the perceived quality of the displayed image as viewed by the user. Furthermore, when a user makes a large head movement, they may be unable to make out as much detail in the displayed image as they would for a smaller head movement. Thus again, the fidelity and the size of the peripheral region may be set accordingly. The size and/or shape of the peripheral region may also depend on one or more, or all, of the quality (e.g. resolution) of the display panel, the quality of the lens(es) in the (e.g. head-mounted) display system, the refresh rate of the display (e.g. 90 or 120 frames per second), the amount of head movement required to view the peripheral region of the input surface, the extent of the frame buffer(s) for the input frame(s), the processing capability of the rendering circuitry and/or the display composition circuitry, the bandwidth and/or power constraints of the data processing system, the battery life of the data processing system, the user's vision, feedback based on analysis from user(s) and/or developer(s) (e.g. of the application), etc.

In an embodiment, the peripheral region extends all the way around (i.e. surrounds) the central region. In an embodiment, the area of the peripheral region is between 10% and 20% of the area of the input surface of which it forms a part.

Similarly, the input surface(s) may be generated at any suitable and desired size. In an embodiment, the one or more input surfaces are generated across a large enough extent (e.g. field of view) to be able to provide output surfaces for most reasonable (e.g. including more extreme) head movements, e.g. based on the type of images being generated. When the head movement is too rapid, e.g. between successive output surfaces being selected from an input surface, then at least part of an output surface may be attempted to be selected from a region outside the boundary of the input surface, which may be desired to be avoided.

In another embodiment, the step of generating the one or more input surfaces comprises generating a plurality of input surfaces, with (e.g. at least) one of the plurality of input surfaces being generated at a lower fidelity than another of the plurality of input surfaces. Thus, in an embodiment, the step of generating a plurality of input surfaces comprises generating a first input surface at a particular (e.g. high) fidelity and generating a second input surface at a lower fidelity than the fidelity of the first input surface.

In this embodiment, the plurality of input surfaces may comprise a plurality of versions of the same input surface. Thus, in an embodiment, each of the plurality of input surfaces represents the same image for display, e.g. just at different fidelities. In an embodiment, the plurality of input surfaces is generated for a particular time step in the rendering of input frames for display (and thus another set of plural input surfaces is generated at the next time step, e.g. based on the received view orientation data at this time).

The plurality of input surfaces may be any suitable and desired (e.g. relative) size. In one set of embodiments the plurality of input surfaces are the same (e.g. shape and) size and, e.g., generated over the same field of view as each other.

In another set of embodiments the plurality of input surfaces may not be the same (e.g. shape) and size, or generated over the same field of view as each other. In an embodiment, at least one of the plurality of input surfaces is smaller than the other of the plurality of input surfaces and is, e.g., generated over a smaller field of view than the other of the plurality of input surfaces. In an embodiment, an input surface having a higher fidelity than the other of the plurality of input surfaces is smaller than the other of the plurality of input surfaces. In an embodiment, the smaller, high fidelity input surface corresponds to a central region of the other (larger, lower fidelity) of the plurality of input surfaces.

Thus, in an embodiment both a larger, lower fidelity input surface and a smaller, higher fidelity input surface corresponding to a central region of the lower fidelity input surface are generated. The smaller, higher fidelity input surface is then able to be used to provide higher fidelity data from the central region for an output surface and the larger, lower fidelity input surface is able to be used to provide lower fidelity data for the peripheral region for the output surface, as is suitable and desired.

The differently sized input surfaces may be generated having their different respective sizes. Alternatively the plurality of input surfaces may be generated at the same size initially, and then the differently sized input surfaces may be formed, for example, when deriving one or more of the input surfaces from another of the input surfaces or when writing out the plurality of the input surfaces (e.g. to a frame buffer). For example, not all of an initially generated input surface may be written out, so to form a smaller input surface.

Any suitable and desired number of input surfaces may be generated when generating the plurality of input surfaces, though in this embodiment this will include, inter alia, an input surface generated at a higher fidelity and an input surface generated at a lower fidelity. In an embodiment, each of the plurality of input surfaces is generated at a different respective fidelity. Thus, the step of generating a plurality of input surfaces may comprise generating a plurality of input surfaces at a plurality of different respective fidelities. As discussed above, each of these input surfaces may be a different size, e.g. covering the full or a portion of the (e.g. largest input) surface.

When a plurality of input surfaces are generated at a plurality of different fidelities, in an embodiment the each of the plurality of input surfaces is generated at a uniform fidelity over the area of the respective input surface (for the level of fidelity that a particular input surface is generated at).

The input surface having a lower fidelity periphery or the plurality of input surfaces with (at least) one of the input surfaces having a lower fidelity may be generated in any suitable and desired way, e.g. the lower fidelity periphery or the lower fidelity surface(s) may be generated in any suitable and desired way. In one embodiment the rendering circuitry is operable to generate the one or more input surfaces at the different (i.e. lower and higher) fidelities (either within the one input surface or in the different respective surfaces) when (initially) rendering the one or more input surfaces. Thus the lower fidelity periphery or lower fidelity surface(s) may be produced initially (e.g. by the GPU when executing instructions for an application) at a lower fidelity. Likewise, the higher fidelity central region or higher fidelity surface(s) may be produced initially at a higher fidelity (e.g. such that the different parts of a surface or the different surfaces are produced originally without being derived from other parts of a surface or surfaces generated previously).

However, in another embodiment the lower fidelity periphery or lower fidelity surface(s) are derived from (at least) parts of an input surface generated at a higher fidelity, e.g. generated by compressing the relevant parts of an input surface generated at a higher fidelity. Thus in one embodiment the method comprises generating an initial input surface (e.g. at a particular, e.g. uniform, e.g. high, fidelity) and compressing the periphery of the initial input surface to convert the initial input surface into an input surface having a periphery at a lower fidelity than the fidelity of the periphery generated in the initial input surface (and at a lower fidelity than the fidelity of the central region of the (initial and converted) input surface), or deriving one or more further input surfaces from the initial input surface (e.g. each) having a lower fidelity than the fidelity of the initial input surface. Thus, in an embodiment, the lower fidelity periphery of the input surface or the lower fidelity input surface(s) are lower fidelity versions of the corresponding (e.g. periphery of) a higher fidelity input surface and are produced as such (e.g. by generating the higher fidelity input surface first and then creating the lower fidelity version(s) therefrom).

For the latter embodiment, the method may comprise (e.g. first generating and then) compressing the (e.g. higher fidelity) initial input surface to derive the one or more further input surfaces having a lower fidelity than the fidelity of the initial input surface. For both of these embodiments, the data processing system may comprise compression circuitry operable to compress the (e.g. periphery of the) initial input surface.

The Applicant has appreciated that, e.g. as well as compressing the (e.g. parts of the) initial input surface to form the lower fidelity (e.g. parts of the) input surface, it may also be possible to compress the (e.g. parts of the) initial input surface that are to form the higher (or highest) fidelity (e.g. parts of the) input surface, e.g. without any (noticeable) loss in fidelity. This may be achieved, for example, by using lossless compression techniques which may, for example, exploit redundancies in data values over parts of the initial input surface. Thus the whole of the initial input surface may be compressed, with the higher fidelity version(s) or part(s) of the input surface being compressed using lossless (or less lossy) compression and the lower fidelity version(s) or part(s) of the input surface being compressed using lossy (or more lossy) compression.

It will be appreciated, when one or more of a plurality of input surfaces are derived from an (e.g. initial) input surface, the plurality of input surfaces may not be generated at the same time and/or by the same component. Thus, in one set of embodiments, an initial (e.g. higher fidelity) input surface may be generated (e.g. by an application executing on a CPU) and the other (e.g. lower fidelity) of the plurality of input surfaces are derived subsequently (e.g. by a GPU) from the initial input surface, e.g. by compressing the initial input surface. The other of the plurality of input surfaces may be formed when the initial input surface is being processed to perform asynchronous time-warp and/or lens correction.

The (e.g. periphery of the) initial input surface may be compressed in any suitable and desired way. In one embodiment the rendering circuitry is operable to compress the (e.g. periphery of the) initial input surface (and thus the rendering circuitry may comprise compression circuitry for this purpose). Thus the rendering circuitry may generate the (e.g. periphery of the) initial input surface in a compressed format. In this embodiment, therefore, the rendering circuitry both generates and then compresses the initial input surface, e.g. before the input surface(s) are written out (e.g. to a frame buffer). Thus, in an embodiment, the rendering circuitry is operable to generate the initial input surface and to compress the (e.g. periphery of the) initial input surface, either to form an input surface having a periphery at a lower fidelity than the fidelity of the periphery generated in the initial input surface or to form one or more further input surfaces having a lower fidelity (e.g. across the whole of the input surface) than the fidelity of the initial input surface.

In another embodiment the rendering circuitry generates the initial input surface (e.g. at a particular, e.g. uniform, e.g. high, fidelity) and the (e.g. periphery of the) initial input surface is compressed when the input surface is written out, i.e. to generate either an input surface having a periphery at a lower fidelity than the fidelity of the periphery generated in the initial input surface or to generate one or more further input surfaces having a lower fidelity than the fidelity of the initial input surface. Thus, in an embodiment, the method comprises (and the data processing system comprises (e.g. separate) compression (e.g. write-out) circuitry operable to) compressing the (e.g. periphery of the) initial input surface when writing out (e.g. to a (frame) buffer) a compressed version of the (e.g. periphery of the) initial input surface either to write out an input surface having a periphery at a lower fidelity than the fidelity of the periphery generated in the initial input surface or to write out one or more further input surfaces having a lower fidelity than the fidelity of the initial input surface.

One such frame buffer compression technique is described in the Applicant's U.S. Pat. No. 8,542,939 B2, U.S. Pat. No. 9,014,496 B2, U.S. Pat. No. 8,990,518 B2 and U.S. Pat. No. 9,116,790 B2. Replicating the initial input surface generated to produce the compressed lower fidelity parts or versions of the input surface helps to avoid having to generate multiple parts or versions of each input surface from first principles.

The fidelity of the (e.g. periphery) of the input surface(s) may be lower than the fidelity of the other (e.g. regions of the) input surface(s) in any suitable and desired characteristic of the fidelity. In one embodiment the (e.g. periphery) of the input surface(s) having a lower fidelity comprises a lower resolution (e.g. density of data elements (e.g. pixels)) than the resolution in the higher fidelity (e.g. central region of the) input surface(s).

Other characteristics that may be varied (e.g. instead of or in addition to the resolution) to obtain a lower fidelity include using lower precision and/or using a smaller dynamic range (e.g. for any of the data generated and stored relating to the display of the input surface(s)) and/or using a higher lossy compression rate, etc. As described above, this difference in one or more of these characteristics to obtain the lower fidelity may be achieved in any suitable and desired way, e.g. using compression techniques.

It is also believed that the generation of the input surface(s), e.g. as described above, may be new and advantageous in its own right. Thus an embodiment of the technology described herein comprises a method of generating one or more input surfaces for use in providing an output surface for display, the method comprising:

generating one or more input surfaces to be used for providing an output surface for display, wherein the step of generating one or more input surfaces comprises generating a peripheral region of an input surface at a lower fidelity than the fidelity at which a central region of the input surface is generated and/or generating one of a plurality of input surfaces at a lower fidelity than the fidelity at which another of the plurality of input surfaces is generated, and wherein the one or more input surfaces are generated over a field of view that is greater than the field of view of the output surface; and writing out the one or more generated input surfaces to a memory for use in providing an output surface for display.

Another embodiment of the technology described herein comprises an apparatus for generating one or more input surfaces for use in providing an output surface for display, the apparatus comprising:

rendering circuitry operable to generate one or more input surfaces to be used for providing an output surface for display, wherein the rendering circuitry is operable to generate a peripheral region of an input surface at a lower fidelity than the fidelity at which a central region of the input surface is generated and/or to generate one of a plurality of input surfaces at a lower fidelity than the fidelity at which another of the plurality of input surfaces is generated, and wherein the rendering circuitry is operable to generate the one or more input surfaces over a field of view that is greater than the field of view of the output surface; and write out circuitry operable to write out the one or more generated input surfaces to a memory for use in providing an output surface for display.

Once one or more input surfaces have been generated (e.g. in the manner of any of the embodiments outlined above), part of at least one of the input surface(s) is selected, based on the received view orientation (e.g. head pose) data, to provide an output surface for display. In an embodiment, an output surface for display is selected from a smaller field of view (e.g. area) than the field of view (e.g. area) over which the input surface(s) have been generated. Thus, in an embodiment, an output surface for display does not use the full extent of the input surface(s) when the part of at least one of the input surface(s) is selected.

As will be appreciated by those skilled in the art, these embodiments of the technology described herein can include any one or more or all of the optional features of the technology described herein discussed herein, as appropriate.

In these and other embodiments of the technology described herein, it will be appreciated that while the method and data processing system or apparatus may be configured to generate the one or more input surfaces in the manner of one of the main embodiments (e.g. having a peripheral region of an input surface at a lower fidelity or with one of a plurality of input surfaces at a lower fidelity), the method and data processing system or apparatus may be configured to generate the one or more input surfaces in the manner of both of these embodiments. The method and data processing system or apparatus may then be configured to select between the one or more input surfaces generated in these ways when providing an output surface and/or the method and data processing system or apparatus may be configured, when generating the one or more input surfaces (or, e.g., a sequence thereof), to selectively generate the one or more input surfaces in the manner of one or the other of these main embodiments, as desired.

The part of at least one of the one or more generated input surfaces may be selected, based on the received view orientation data, to provide an output surface for display in any suitable and desired way. In an embodiment, the step of selecting part of at least one of the one or more generated input surfaces comprises (and the display composition circuitry is operable to) reading part of at least one of the one or more generated input surfaces (e.g. based on the received view orientation data) for providing an output surface for display.

In an embodiment, the method comprises (and the display composition circuitry is operable to) determining, using the received view orientation data, for a data element position in an output surface that is to be output for display, a corresponding position in the one or more input surfaces; and sampling the data at the determined corresponding position in one of the one or more input surfaces to provide data for use at the data element position in the output surface.

Once the position or positions in the input surface whose data is to be used for a data element (sampling position) in the output surface has been determined, then in an embodiment, the input surface is sampled at the determined position or positions, so as to provide the data values to be used for the data element (sampling position) in the output surface. The input surface(s) may be sampled in any suitable and desired manner in this regard.

Therefore in one embodiment (e.g. when a single input surface is generated, with the input surface being generated at a lower fidelity around its periphery than at its centre) an output surface is simply selected from the appropriate part of this input surface (i.e. based on the received view orientation data). The whole of the output surface may therefore be selected from a single input surface.

Thus, when the received view orientation data indicates that there is no or little head movement, for example, the output surface may only be selected from (e.g. part of) the central region (at the higher fidelity) from the input surface (depending on the relative size of the output surface compared to the input surface) and none of the periphery of the input surface at the lower fidelity.

When the received view orientation data indicates that there is a large head movement (e.g. in a small period of time), (e.g. at least part of) the output surface may be selected from a part of the input surface that includes the periphery (at the lower fidelity). In this circumstance the output surface may also (or may not, depending on the received view orientation data, for example) include part of the central region.

In another embodiment (e.g. when a plurality of input surfaces are generated, with at least one of them at a lower fidelity than another of the input surfaces) an output surface may be selected using the plurality of input surfaces in any suitable and desired way, based on the received view orientation data. Again, in an embodiment, the received view orientation data is used to select the appropriate part of the input surface(s) for use in the output surface for display.

In an embodiment, the received view orientation data is used to select which of the plurality of generated input surfaces is to be used to form the output surface. Only a single input surface may be used to select a part thereof to form the output surface. For example, when the received view orientation data indicates that there is little or no head movement, solely the input surface with the higher or highest fidelity may be used to select a part thereof to form the output surface, for example.

Conversely, when the received view orientation data indicates that there is a large head movement (e.g. in a small time period), solely the input surface with the lower or lowest fidelity may be used to select a part thereof to form the output surface, for example.

However, in this embodiment, because multiple input surfaces have been generated, parts from more than one of the input surfaces may be selected to form the output surface. In an embodiment, the method comprises (and the display composition circuitry is operable to), for a data element position in an output surface, sampling the data at the corresponding position in a lower fidelity input surface (to provide data for use for the data element at the position in the output surface) when (e.g. the received view orientation data indicates that) the corresponding position lies in the peripheral region of the one or more input surfaces.

Correspondingly, in an embodiment the method also comprises (and the display composition circuitry is operable to), for a data element position in an output surface, sampling the data at the corresponding position in a higher fidelity input surface (to provide data for use for the data element at the position in the output surface) when (e.g. the received view orientation data indicates that) the corresponding position lies in the central region of the one or more input surfaces.

(When an input surface has been generated with a peripheral region having a lower fidelity than a central region, the peripheral region for the corresponding position for the data element position in an output surface is, in an embodiment, this same peripheral region having the lower fidelity. However, when a plurality of input surfaces have been generated (with one thereof at a lower fidelity), in an embodiment, a peripheral region (e.g. of data element positions in the input surfaces) is defined (e.g. in the same manner as when a single, variable fidelity, input surface is generated) in order to determine when the corresponding position lies in the peripheral (and thus also the central) region.)

It will be appreciated that by using the determined corresponding position in the plurality of input surfaces to select which level of fidelity to use in (i.e. to sample for) the output surface may result in the same output display as in the embodiment in which a single input surface (having a lower fidelity periphery) is generated (e.g. provided that the peripheral region for the plurality of input surfaces is defined in the same way).

It will be appreciated from the above that in an embodiment, the display composition circuitry operates by reading as an input one or more sampling positions (e.g. pixels) in the input surface and using those sampling positions to generate an output sampling position (e.g. pixel) of the output surface. In other words, in an embodiment, the display composition circuitry operates to generate the output surface by generating the data values for respective sampling positions (e.g. pixels) in the output surface from the data values for sampling positions (e.g. pixels) in the input surface.

(As will be appreciated by those skilled in the art, the defined sampling (data) positions (data elements) in the input surface (and in the output surface) may (and in one embodiment do) correspond to the pixels of the display, but that need not necessarily be the case. For example, where the input surface and/or output surface is subject to some form of downsampling, then there will be a set of plural data (sampling) positions (data elements) in the input surface and/or output surface that corresponds to each pixel of the display, rather than there being a one-to-one mapping of surface sampling (data) positions to display pixels).)

Thus, in an embodiment, the display composition circuitry operates for a, e.g. for plural, and e.g. for each, sampling position (data element) that is required for the output surface, to determine for that output surface sampling position, a set of one or more (and, e.g., a set of plural) input surface sampling positions to be used to generate that output surface sampling position, and then uses those determined input surface sampling position or positions to generate the output surface sampling position (data element).

As outlined above, in an embodiment, the level of fidelity of the data sampled from the input frame(s) for the output frame depends on the position in the input frame(s). Thus, for example, when the position in the input frame(s) being sampled falls in the peripheral region of the input frame(s), the lower fidelity data is used, this being either from the lower fidelity peripheral region of a variable fidelity input frame or from the peripheral region of a lower fidelity version of the input frame.

In an embodiment, the level of fidelity of the data sampled is based on (takes account of) one or more other factors, as well as the view orientation.

In an embodiment, the level of fidelity of the data sampled also takes account of (is based on) any distortion, e.g. barrel distortion, that will be caused by a lens or lenses through which the displayed output surface will be viewed by a user. The Applicant has recognised in this regard that the output frames displayed by virtual reality headsets are typically viewed through lenses, which lenses commonly apply geometric distortions, such as barrel distortion, to the viewed frames.

Accordingly, owing to the (geometric) distortion that such a lens or lenses will cause, particularly around the periphery of an output surface for display where there may be a greater distortion, it may create no noticeable difference to use lower fidelity data in a peripheral region of an output frame, e.g. in addition to the lower fidelity data being used when sampling from the peripheral region of the input frame(s).

Thus, in an embodiment, the display composition circuitry is operable to take account of (expected) (geometric) distortion from a lens or lenses that an output surface will be viewed through, and to select the level of fidelity of data to be used in the output surface based on that (expected) lens (geometric) distortion. This may increase the fraction of lower fidelity data which is being used (compared to the higher fidelity data being used) which thus helps to consume less memory bandwidth, etc., e.g. when reading the input surface data, time-warping and writing out the output surfaces.

Thus, when a plurality of input surfaces are generated, with at least one of them at a lower fidelity than another of the input surfaces, in an embodiment, the method comprises (and the display composition circuitry is operable to) determining, for data element positions in the peripheral region of an output surface, corresponding positions in the lower fidelity input surface; and sampling the data at the determined corresponding positions in the lower fidelity input surface to provide data for use at the data element positions in the peripheral region of the output surface.

The peripheral region of an output frame may be determined in any suitable and desired way, and thus may have any suitable and desired size and/or shape, e.g. based on the known distortion of the lens(es) through which the display is viewed. The size and/or shape of the peripheral region of an output frame may also or instead be based on, e.g. as for the peripheral region of an input surface or surfaces, one or more, or all, of the quality (e.g. resolution) of the display panel, the quality of the lens(es) in the (e.g. head-mounted) display system, the refresh rate of the display, the amount of head movement required to view the peripheral region of the input surface, the extent of the frame buffer(s) for the input frame(s), the processing capability of the rendering circuitry and/or the display composition circuitry, the battery life of the data processing system, the user's vision, etc.

The view orientation data may be any suitable and desired data that is indicative of a view orientation (view direction). In an embodiment, the view orientation data represents and indicates a desired view orientation (view direction) that part of the input surface(s) (i.e. the output surface) is to be displayed as if viewed from (that the part of the input surface(s) that is selected is to be displayed with respect to).

In an embodiment, the view orientation data indicates the orientation of the view position that the part of the input surface(s) is to be displayed for relative to a reference (e.g. predefined) view position (which may be a "straight ahead" view position but need not be). In an embodiment, the reference view position is the view position (direction (orientation)) that the input surface(s) were generated (rendered) with respect to. Thus, in an embodiment, the view orientation data indicates the orientation of the view position that the part of the input surface(s) is to be displayed for relative to the view position (direction) that the input surface(s) were generated (rendered) with respect to.

In an embodiment, the view orientation data indicates a rotation of the view position that the part of the input surface(s) is to be displayed for relative to the reference view position. The view position rotation may be provided as desired, such as in the form of three (Euler) angles or as quaternions. Thus, in an embodiment, the view orientation data comprises one or more (and, e.g., three) angles (Euler angles) representing the orientation of the view position that part of the input surface(s) is to be displayed for relative to a reference (e.g. predefined) view position.

The view orientation data may be provided to the display composition circuitry in use in any appropriate and desired manner. In an embodiment, it is provided appropriately by the application that requires the display of the output surface. In an embodiment, the view orientation data is provided to the display composition circuitry, e.g., at a selected (and, e.g., predefined) rate, with the display composition circuitry then using the provided view orientation data as appropriate to control its operation. In an embodiment, updated view orientation data is provided to the display composition circuitry at the display refresh rate, e.g. 90 Hz or 120 Hz.

The view orientation data that is used by the display composition circuitry when generating an output surface from part of an input surface or surfaces can be provided to (received by) the display composition circuitry in any suitable and desired manner. In an embodiment, the view orientation data is written into suitable local storage (e.g. a register or registers) of the display composition circuitry from where it can then be read and used by the display composition circuitry when generating an output surface from part of an input surface or surfaces.

In an embodiment, the view orientation data comprises head position data (head pose tracking data), e.g., that has been sensed from appropriate head position (head pose tracking) sensors of a virtual reality display headset that the display composition circuitry is providing images for display to. The circuitry for determining the view orientation data, e.g. including any head position (head pose tracking) sensors and associated logic, may be provided within or outside a head mounted display, as is suitable and desired. For example, the head position sensors may comprise one or more accelerometers that may be located inside a head mounted display. Additional sensors may also be provided, such as radio or visual tracking sensors, which may be external to the head mounted display. These may be used instead of, or together with, other sensors (e.g. accelerometers) to determine the view orientation data.

In an embodiment, the, e.g. sampled, view orientation (e.g. head position (pose)) data is provided to the display composition circuitry in an appropriate manner and at an appropriate rate (e.g. the same rate at which it is sampled by the associated head-mounted display). The display composition circuitry can then use the provided head pose tracking (view orientation) information as appropriate to control its operation.

Thus, in an embodiment, the view orientation data comprises appropriately sampled head pose tracking data that is, e.g., periodically determined by a virtual reality headset that the display composition circuitry is coupled to (and providing the output surface for display to).

The display composition circuitry may be integrated into the headset (head-mounted display) itself, or it may otherwise be coupled to the headset, for example via a wired or wireless connection.

Thus, in an embodiment, the method of the technology described herein comprises (and the display composition circuitry and/or data processing system is appropriately configured to) periodically sampling view orientation data (e.g. head position data) for use by the display composition circuitry (e.g. by means of appropriate sensors of a head-mounted display that the display composition circuitry is providing the output transformed surface for display to), and periodically providing sampled view orientation data to the display composition circuitry, with the display composition circuitry then using the provided sampled view orientation data when selecting part of an input surface or surfaces to provide an output surface.

In an embodiment, the display composition circuitry is configured to update its operation based on new view orientation data (head tracking data) at appropriate intervals, such as at the beginning of generating each (e.g. set of) input surface(s) and/or each output surface. In an embodiment, the display composition circuitry updates its operation based on the latest provided view orientation (head tracking) information periodically, and, e.g., each time an output surface is to be generated.

In one embodiment, as well as the output surface(s) being selected based on the received view orientation data, e.g. to determine whether to select low or high fidelity data from the input surface (s), the rendering circuitry is operable to generate the input surface (s) at a level of fidelity that is based on the received view orientation data. Thus, for example, when the received view orientation data indicates that there is no or little head motion, the rendering circuitry may generate the input surface (s) at a higher fidelity (but, e.g., at a lower frame rate). Conversely, for example, when the received view orientation data indicates that there is significant head motion, the rendering circuitry may generate the input surface (s) at a lower fidelity (but, e.g., at a higher frame rate).

Thus, in an embodiment, the rendering circuitry is operable to switch between a higher fidelity (and, e.g., lower frame rate) mode and a lower fidelity (and, e.g., higher frame rate) mode based on the received view orientation data, wherein the rendering circuitry is operable, when the received view orientation data indicates that there is no or little head movement, to generate input frames in the higher fidelity (and, e.g., lower frame rate) mode at a higher fidelity (and, e.g., at a lower frame rate) and, when the received view orientation data indicates that there is large head movement, to generate input frames in the lower fidelity (and, e.g., higher frame rate) mode at a lower fidelity (and, e.g., at a higher frame rate).

The higher fidelity and lower fidelity modes may be selected by the rendering circuitry, based on the received view orientation data, in any suitable and desired way. For example, the rendering circuitry may switch to the lower fidelity mode when the received view orientation data indicates that the head movement of the user is such that some of the output surface(s) generated from an input surface will be attempted to be selected from outside of the boundary of the input surface. Thus, by switching to the lower fidelity mode and, for example, generating the input surfaces at a higher frame rate, the input surfaces can be generated (based on the received view orientation data) to accommodate the large head movement for the output surface(s) that are to be selected from each input surface.

When a plurality of input surfaces are generated (with one thereof at a lower fidelity), such input surfaces may be made available to (e.g. written out to a frame buffer for) the display composition circuitry at different times, e.g. owing to the time taken to generate these surfaces. As will be appreciated, higher fidelity surfaces may take longer to generate and thus, in an embodiment, the display composition circuitry is operable to select an output surface from the input surfaces available at the time of selecting the part of the input surface(s) to form the output surface.

Thus, in an embodiment, should the higher fidelity surface(s) not be available (e.g. at first), the display composition circuitry is operable to select an output surface from the lower fidelity surface(s), when available. As and when the higher fidelity surface(s) become available, the display composition circuitry may select the output surface from the higher fidelity surface(s), should this be determined to be appropriate based on the received view orientation data.

It is also believed that the composition of an output surface may be new and advantageous in its own right. Thus an embodiment of the technology described herein comprises a method of composing an output surface for display, the method comprising:

selecting part of an input surface to form an output surface for display, wherein the input surface comprises a peripheral region having a lower fidelity than the fidelity of a central region of the input surface; or selecting parts from a plurality of input surfaces to form an output surface for display, wherein the plurality of input surfaces comprise an input surface having a lower fidelity than the fidelity of another of the plurality of input surfaces;

wherein the field of view of the output surface is smaller than the field of view of the input surface or the plurality of input surfaces, and wherein the step of selecting part of an input surface or selecting parts from a plurality of input surfaces is based on received view orientation data; and providing the output surface to a display.

Another embodiment of the technology described herein comprises an apparatus for composing an output surface for display, the apparatus comprising:

display composition circuitry operable to:

select part of an input surface to form an output surface for display, wherein the input surface comprises a peripheral region having a lower fidelity than the fidelity of a central region of the input surface; or select parts from a plurality of input surfaces to form an output surface for display, wherein the plurality of input surfaces comprise an input surface having a lower fidelity than the fidelity of another of the plurality of input surfaces;

wherein the field of view of the output surface is smaller than the field of view of the input surface or the plurality of input surfaces, and wherein the display composition circuitry is operable to select part of an input surface or parts from a plurality of input surfaces based on received view orientation data; and a display controller for providing the output surface to a display.

As will be appreciated by those skilled in the art, these embodiments of the technology described herein can include any one or more or all of the optional features of the technology described herein discussed herein, as appropriate.

The above embodiments of the technology described herein have been based on generating multiple input surfaces at different fidelities or a single input surface with a lower fidelity peripheral region (compared to a higher fidelity central region). However, the Applicants have recognised that a similar effect for output surfaces may be able to be provided by generating only a single input surface, e.g. having the same (e.g. higher) fidelity across the surface (for both the central and peripheral regions), but then producing lower or higher fidelity output surface regions from that input surface during the display process.

In this case therefore, the output surface that is, e.g., provided for display will be generated by writing out regions of the input surface at different fidelities to form the output surface, e.g., depending on the respective positions of the regions in the input surface (based on the received view orientation data) and/or in the output surface. In this case only a single input surface may have to be provided and, with the display process (e.g. a GPU) then producing and writing out (e.g. to memory), the necessary higher and/or lower fidelity regions for the output surface that is displayed.

This may be new and advantageous in its own right. Thus an embodiment of the technology described herein comprises a method of providing an output surface for display, the method comprising:

generating an input surface to be used for providing an output surface for display; and when using the input surface to provide an output surface for display:

for each of a plurality of regions of the input surface to be used for providing the output surface:

selecting a fidelity at which to provide the input surface region for the output surface based on received view orientation data; and providing the input surface region for use for the output surface at the selected fidelity.

Another embodiment of the technology described herein comprises a data processing system for providing an output surface for display, the data processing system comprising:

rendering circuitry operable to generate an input surface to be used for providing an output surface for display; and display composition circuitry operable to:

use the input surface to provide an output surface for display; and for each of a plurality of regions of the input surface to be used for providing the output surface:

select a fidelity at which to provide the input surface region for the output surface based on received view orientation data; and provide the input surface region for use for the output surface at the selected fidelity.

As will be appreciated by those skilled in the art, these embodiments of the technology described herein can include any one or more or all of the optional features of the technology described herein discussed herein, as appropriate. The region of the input surface may be a (single) data element (e.g. pixel) but, in an embodiment, the region of the input surface comprises a block of a plurality of data elements (e.g. pixels).

In an embodiment, the fidelity is selected, based on the received view orientation data, in the same manner as the regions of the input surfaces are generated, as outlined for previous embodiments. Thus, in an embodiment, the fidelity at which to provide the input surface region for the output surface, based on the received view orientation data, is selected based on the position of the input surface region in the input surface that is to be provided for use for the output surface.

For example, when the region (e.g. block) of the input surface to be provided is from a central region of the input surface (e.g. when the received view orientation data indicates that there is little or no head movement), the input surface region may be selected and provided at a higher fidelity (e.g. the original fidelity at which the input surface was generated).

Thus, in an embodiment, the input surface is generated at a higher fidelity.

Alternatively, when the region (e.g. block) of the input surface to be provided is a peripheral region of the input surface (e.g. when the received view orientation data indicates that there is a large head movement), the input surface region may be selected and provided at a lower fidelity.

In an embodiment the fidelity of the input surface that is selected and provided may also depend on the position of the region of the output surface that the region of the input surface is to be provided for. Thus, for example, when a region of an input surface is to be provided for use in a central region of the output surface, in an embodiment the region of the input surface is selected and provided at the original (e.g. higher) fidelity.

However, when the region of the input surface to be provided has been selected, based on the received view orientation data, to be provided at a lower fidelity, e.g. when the received view orientation data indicates that there is a large head movement, the region of the input surface to be provided may be selected and provided at a lower fidelity, even when it is for use in a central region of the output surface (which may otherwise be selected and provided from the input surface at a higher fidelity).

When a region of an input surface is to be provided for use in a peripheral region of the output surface, in an embodiment the region of the input surface is selected and provided at a lower fidelity. In an embodiment, such a region of the input surface is selected and provided at a lower fidelity even when region is in a central region of the input surface (and thus may otherwise be provided at the original (higher) fidelity).

In an embodiment, the regions of the input surface are provided at a higher or lower fidelity in the same manner as the (higher and lower fidelity) regions of the input surfaces are generated, as outlined for previous embodiments. Thus, for example, a region of an input surface that is selected and provided at a lower fidelity is provided for use in an output surface by compressing the original (e.g. higher fidelity) region of the input surface, e.g. when writing out the region of the input surface to a frame buffer. Correspondingly, in an embodiment, a region of an input surface that is selected and provided at a higher (e.g. original) fidelity is provided for use in an output surface by writing out (i.e. without compressing) the original (e.g. higher fidelity) region of the input surface, e.g. to a frame buffer.

As well as the rendering circuitry and the display composition circuitry discussed above, the data processing system of the technology described herein can otherwise include any one or more or all of the processing stages and elements that a data processing system may suitably comprise.

In an embodiment, the data processing system further comprises one or more layer pipelines operable to perform one or more processing operations on one or more input surfaces, as appropriate, e.g. before providing the one or more processed input surfaces to the display processing circuitry, a scaling stage and/or composition stage, or otherwise. Where the data processing system can handle plural input layers, there may be plural layer pipelines, such as a video layer pipeline or pipelines, a graphics layer pipeline, etc. These layer pipelines may be operable, for example, to provide pixel processing functions such as pixel unpacking, colour conversion, (inverse) gamma correction, and the like.

The data processing system may also include a post-processing pipeline operable to perform one or more processing operations on one or more surfaces, e.g. to generate a post-processed surface. This post-processing may comprise, for example, colour conversion, dithering, and/or gamma correction.

In an embodiment, the data processing system further comprises a write-out stage operable to write an input surface or surfaces to external memory. This will allow the rendering circuitry to write an input surface or surfaces to external memory (such as a frame buffer), e.g., from where it can be read (e.g. selectively) by the display composition circuitry when generating an output surface.

In an embodiment, the data processing system further comprises a write-out stage operable to write an output surface to external memory. This will allow the display composition circuitry to, e.g., (selectively) write an output surface to external memory (such as a frame buffer), e.g., at the same time as an output surface is being displayed on the display.

In such an arrangement, in an embodiment, the data processing system accordingly operates both to display the output surface and to write it out to external memory (as it is being generated and provided by the display composition circuitry). This may be useful where, for example, an output (time-warped) surface may be desired to be generated by applying a set of difference values to a previous ("reference") output surface. In this case the write-out stage of the data processing system could, for example, be used to store the "reference" output surface in memory, so that it is then available for use when generating future output surfaces.

Other arrangements would, of course, be possible.

The various circuitry and stages of the data processing system may be implemented as desired, e.g. in the form of one or more fixed-function units (hardware) (i.e. that is dedicated to one or more functions that cannot be changed), or as one or more programmable processing stages, e.g. by means of programmable circuitry that can be programmed to perform the desired operation. There may be both fixed function and programmable stages.

One or more of the various stages of the data processing system may be provided as separate circuit elements to one another. Additionally or alternatively, some or all of the stages may be at least partially formed of shared circuitry.

It would also be possible for the data processing system to comprise, e.g., two display processing cores, with one or more or all of the cores being configured in the manner of the technology described herein, when desired.

The display that the data processing system of the technology described herein is used with may be any suitable and desired display (display panel), such as for example, a screen. It may comprise the data processing system's (device's) local display (screen) and/or an external display. There may be more than one display output, when desired.

In an embodiment, the display that the data processing system is used with comprises a virtual reality or augmented reality head-mounted display. In an embodiment, that display accordingly comprises a display panel for displaying the output surfaces generated in the manner of the technology described herein to the user, and a lens or lenses through which the user will view the displayed output frames.

Correspondingly, in an embodiment, the display has associated view orientation determining (e.g. head tracking) sensors, which, e.g. periodically, generate view tracking information based on the current and/or relative position of the display, and are operable to provide that view orientation data periodically to the data processing system (to the display composition circuitry and, when required, to the rendering circuitry of the data processing system) for use when selecting parts of an input surface or surfaces to provide an output surface for display and, when required, for use when generating an input surface or surfaces.

The data processing system may comprise one or more of, e.g. all of: a central processing unit, a graphics processing unit, a video processor (codec), a display controller, a system bus, and a memory controller.

The data processing system may be configured to communicate with one or more of (and the technology described herein also extends to an arrangement comprising one or more of): an external memory (e.g. via the memory controller), one or more local displays, and/or one or more external displays. In an embodiment, the external memory comprises a main memory (e.g. that is shared with the central processing unit (CPU)) of the data processing system.

Thus, in some embodiments, the data processing system comprises, and/or is in communication with, one or more memories and/or memory devices that store the data described herein, and/or store software for performing the processes described herein. The data processing system may also be in communication with and/or comprise a host microprocessor, and/or with and/or comprise a display for displaying images based on the data generated by the data processing system.

Correspondingly, an embodiment of the technology described herein comprises a data processing system comprising:

a main memory;

a display;

one or more rendering processing units operable to generate input surfaces for display and to store the input surfaces in the main memory, wherein the rendering processing units are operable to generate a peripheral region of an input surface at a lower fidelity than the fidelity at which a central region of the input surface is generated or are operable to generate one of a plurality of input surfaces at a lower fidelity than the fidelity at which another of the plurality of input surfaces is generated; and a display composition stage, the display composition stage comprising:

an input stage operable to read an input surface stored in the main memory;

an output stage operable to provide an output surface for display to the display; and a selection stage operable to:

to select part of at least one of the one or more generated input surfaces read by the input stage based on received view orientation data to provide an output surface for display; and provide the output surface to the output stage for providing as an output surface for display to the display.

Another embodiment of the technology described herein comprises a data processing system comprising:

a main memory;

a display;

one or more rendering processing units operable to generate input surfaces for display and to store the input surfaces in the main memory, wherein the rendering processing units are operable to generate an input surface to be used for providing an output surface for display; and a display composition stage, the display composition stage comprising:

an input stage operable to read an input surface stored in the main memory;

an output stage operable to provide an output surface for display to the display; and a selection stage operable, for each of a plurality of regions of the input surface to be used for providing the output surface, to:

select a fidelity at which to provide the input surface region for the output surface based on received view orientation data; and provide the input surface region to the output stage to provide a region of the output surface at the selected fidelity for display to a display.

As will be appreciated by those skilled in the art, these embodiments of the technology described herein can include one or more of the optional features of the technology described herein described herein, as appropriate.

Thus, for example, the data processing system further comprises one or more local buffers, and, in an embodiment, its input stage is operable to fetch data of input surfaces to be processed by the display controller from the main memory into the local buffer or buffers of the display controller (for then processing by the display composition stage).

In use of the data processing system of the technology described herein, one or more input surfaces will be generated by the rendering circuitry, e.g., by a GPU, CPU and/or video codec, etc. and stored in memory. Those input surfaces will then be processed by the display composition circuitry to provide an output surface for display to the display.

The display composition circuitry may be implemented in any suitable and desired component of the data processing system. In one embodiment the data processing system comprises a GPU comprising the display composition circuitry. Thus, in this embodiment, the GPU may be operable both to generate one or more input surfaces (and, e.g., write out the input surface(s) to a frame buffer) and then to select an output surface from the input surface(s) (thus, e.g., reading in the input surface(s) to do so) in the manner of the technology described herein.

In an embodiment, the GPU then writes out the output surface to an output frame buffer for display. The data processing system may therefore also comprise a display controller operable to provide the output surface to a display, e.g. by reading in the output surface from the output frame buffer and sending the output surface to the display.

In another embodiment, the data processing system comprises a display controller comprising the display composition circuitry. Thus, in this embodiment, the display controller is operable to select an output surface from an input surface or surfaces that have been generated by the rendering circuitry, e.g. by a GPU, in the manner of the technology described herein. Again, in an embodiment, the data processing system comprises a frame buffer to which the input surface(s) are written and from which the display controller reads the input surface(s) to select the output surface.

In this embodiment, because the display controller comprises the display composition circuitry, it may not be necessary to provide (although in some embodiments there will be) an output frame buffer. Thus, in an embodiment, the display controller is operable to send the output frame (once selected from the input frame(s)) for display directly.

Although the technology described herein has been described above with particular reference to the generation of a single output surface from an input surface, as will be appreciated by those skilled in the art, in some embodiments of the technology described herein at least, there will be plural input surfaces being generated, representing successive frames of a sequence of frames to be displayed to a user. In an embodiment, the display composition circuitry of the data processing system will accordingly operate to provide a sequence of plural output surfaces for display. Thus, in an embodiment, the operation in the manner of the technology described herein is used to generate a sequence of plural output surfaces for display to a user. Correspondingly, in an embodiment, the operation in the manner of the technology described herein is repeated for plural output frames to be displayed, e.g., for a sequence of frames to be displayed.

Furthermore, it will be appreciated that in some embodiments of the technology described herein, plural output surfaces may be generated from a (and, e.g., each) (set of) input surface(s). For example, the data processing system of the technology described herein may be operated to perform "asynchronous time-warping" of an input surface or surfaces to generate plural output surfaces. Thus, for each input surface or surfaces generated (e.g. at a rate of 30 frames per second) plural output surfaces are selected therefrom. Any suitable and desired number of output surfaces may be selected from an input surface, e.g. two, three or four. Thus the plural output surfaces may be generated at any suitable and desired rate, e.g. at a rate of 60, 90 or 120 frames per second (e.g. to match the refresh rate of the display). Thus, in an embodiment, the operation in the manner of the technology described herein is used to generate a sequence of plural output surfaces from a single input surface (or set of input surfaces) for display to a user.

The generation of output surfaces may also, accordingly, and correspondingly, comprise generating a sequence of "left" and "right" output surfaces to be displayed to the left and right eyes of the user, respectively. Each pair of "left"

and "right" output surfaces may be generated from a common input surface, or from respective "left" and "right" input surfaces, as desired.

In an embodiment the processing circuitry (e.g. including the rendering circuitry, the display composition circuitry, the compression circuitry and/or the write out circuitry) may be in communication with one or more memories and/or memory devices that store the data described herein, and/or that store software for performing the processes described herein. The processing circuitry may also be in communication with a host microprocessor, and/or with a display for displaying images based on the data described above, or a video processor for processing the data described above.

The technology described herein can be implemented in any suitable system, such as a suitably configured microprocessor based system. In an embodiment, the technology described herein is implemented in a computer and/or micro-processor based system.

In an embodiment, the technology described herein is implemented in a virtual reality or augmented reality display device such as a virtual reality or augmented reality headset. Thus, an embodiment of the technology described herein comprises a virtual reality or augmented reality display device comprising the apparatus and/or data processing system of any one or more of the embodiments of the technology described herein. Correspondingly, an embodiment of the technology described herein comprises a method of operating a virtual reality or augmented reality display device, comprising operating the virtual reality or augmented reality display device in the manner of any one or more of the embodiments of the technology described herein.

The various functions of the technology described herein can be carried out in any desired and suitable manner. For example, the functions of the technology described herein can be implemented in hardware or software, as desired. Thus, for example, unless otherwise indicated, the various functional elements, stages, and "means" of the technology described herein may comprise a suitable processor or processors, controller or controllers, functional units, circuitry, processing logic, microprocessor arrangements, etc., that are operable to perform the various functions, etc., such as appropriately dedicated hardware elements (processing circuitry), and/or programmable hardware elements (processing circuitry) that can be programmed to operate in the desired manner.

It should also be noted here that, as will be appreciated by those skilled in the art, the various functions, etc., of the technology described herein may be duplicated and/or carried out in parallel on a given processor. Equally, the various processing stages may share processing circuitry, etc., when desired.

Furthermore, any one or more or all of the processing stages of the technology described herein may be embodied as processing stage circuitry, e.g., in the form of one or more fixed-function units (hardware) (processing circuitry), and/or in the form of programmable processing circuitry that can be programmed to perform the desired operation. Equally, any one or more of the processing stages and processing stage circuitry of the technology described herein may be provided as a separate circuit element to any one or more of the other processing stages or processing stage circuitry, and/or any one or more or all of the processing stages and processing stage circuitry may be at least partially formed of shared processing circuitry.

It will also be appreciated by those skilled in the art that all of the described embodiments of the technology described herein can include, as appropriate, any one or more or all of the optional features of the technology described herein.

The methods of the technology described herein may be implemented at least partially using software, e.g. computer programs. It will thus be seen that in some embodiments the technology described herein comprises computer software specifically adapted to carry out the methods herein described when installed on a data processor, a computer program element comprising computer software code portions for performing the methods herein described when the program element is run on a data processor, and a computer program comprising software code adapted to perform all the steps of a method or of the methods herein described when the program is run on a data processing system. The data processor may be a microprocessor system, a programmable FPGA (field programmable gate array), etc.

The technology described herein also extends to a computer software carrier comprising such software which when used to operate a data processing system, or microprocessor system comprising a data processor causes in conjunction with said data processor said controller or system to carry out the steps of the methods of the technology described herein. Such a computer software carrier could be a physical storage medium such as a ROM chip, CD ROM, RAM, flash memory, or disk.

It will further be appreciated that not all steps of the methods of the technology described herein need be carried out by computer software and thus in a further embodiment the technology described herein comprises computer software and such software installed on a computer software carrier for carrying out at least one of the steps of the methods set out herein.

The technology described herein may accordingly suitably be embodied as a computer program product for use with a computer system. Such an implementation may comprise a series of computer readable instructions fixed on a tangible, non-transitory medium, such as a computer readable storage medium, for example, diskette, CD-ROM, ROM, RAM, flash memory, or hard disk. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical. It is contemplated that such a computer program product may be distributed as a removable medium with accompanying printed or electronic documentation, for example, shrink-wrapped software, pre-loaded with a computer system, for example, on a system ROM or fixed disk, or distributed from a server or electronic bulletin board over a network, for example, the Internet or World Wide Web.

A number of embodiments of the technology described herein will now be described.

The technology described herein and the present embodiment relates to the process of displaying frames to a user in a virtual reality or augmented reality display system, and in particular in a head-mounted virtual reality or augmented reality display system.

Such a system may be configured as shown in FIG. 1, which shows schematically an exemplary data processing system. The data processing system comprises a host processor comprising a central processing unit (CPU) 7, a graphics processing unit (GPU) 2, a video engine 1, a display controller 5, and a memory controller 8. As shown in FIG. 1, these units communicate via an interconnect 9 and have access to off-chip memory 3. In this system the GPU 2, video engine 1 and/or CPU 7 will generate frames (images) to be displayed and the display controller 5 will then provide the frames to a display panel 4 for display.

In use of this system, an application 10 such as a game, executing on the host processor (CPU) 7 will, for example, require the display of frames on the display 4. To do this, the application 10 will submit appropriate commands and data to a driver 11 for the graphics processing unit 2 that is executing on the CPU 7. The driver 11 will then generate appropriate commands and data to cause the graphics processing unit 2 to render appropriate frames for display and to store those frames in appropriate frame buffers, e.g. in the main memory 3. The display controller 5 will then read those frames into a buffer for the display from where they are then read out and displayed on the display panel of the display 4.

In an embodiment of the technology described herein, the data processing system illustrated in FIG. 1 provides a virtual reality (VR) head mounted display (HMD) system. Thus the display 4 of the system comprises an appropriate head-mounted display that includes, inter alia, a display screen or screens (panel or panels) for displaying frames to be viewed to a user wearing the head-mounted display, one or more lenses in the viewing path between the user's eyes and the display screens, and one or more sensors for tracking the position (pose) of the user's head (and/or their view (gaze) direction) in use (while images are being displayed on the display to the user).

In a head mounted virtual reality display operation, the appropriate images to be displayed to each eye will be rendered by the GPU 2, in response to appropriate commands and data from the application 10, such as a game, (e.g. executing on the CPU 7) that requires the virtual reality display. The GPU 2 will, for example, render the images to be displayed at a rate that matches the refresh rate of the display, such as 30 frames per second.

In such arrangements, the system will also operate to track the movement of the head/gaze of the user (so-called head pose tracking). This head orientation (pose) data is then used to determine how the images should actually be displayed to the user for their current head position (view direction), and the images (frames) are rendered accordingly (for example by setting the camera (viewpoint) orientation based on the head orientation data), so that an appropriate image based on the user's current direction of view can be displayed.

While it would be possible simply to determine the head orientation (pose) at the start of rendering a frame to be displayed in a VR system, because of latencies in the rendering process, it can be the case that the user's head orientation (pose) has changed between the sensing of the head orientation (pose) at the beginning of the rendering of the frame and the time when the frame is actually displayed (scanned out to the display panel).

To allow for this, a process known as "time-warp" is implemented in the virtual reality head-mounted display system in embodiments of the technology described herein. In this process, the frames to be displayed are rendered based on the head orientation data sensed at the beginning of the rendering of the frames, but then before the frames are actually displayed, further head orientation (pose) data is sensed, and that updated head pose sensor data is then used to render an "updated" version of the original frame that takes account of the updated head orientation (pose) data. The "updated" version of the frame is then displayed. This allows the image displayed on the display to more closely match the user's latest head orientation.

To do this processing, the initial, "application" frames are rendered into appropriate buffers in memory, but there is then a second rendering process that takes the initial, application frames in memory and uses the latest head orientation (pose) data to render versions of the initially rendered frames that take account of the latest head orientation to provide the frames that will be displayed to the user. This typically involves performing some form of transformation on the initial frames, based on the head orientation (pose) data. The "time-warp" rendered output frames that are actually to be displayed are written into a further buffer or buffers in memory, from where they are then read out for display by the display controller.

As will be described, in embodiments of the technology described herein, the initial rendering operation to generate the initial, "application" frames is typically carried out by the GPU 2, under appropriate control from the CPU 7. The subsequent "time-warp" rendering operation may be carried out by the GPU 2 or the display controller 5, again under appropriate control from the CPU 7. Thus, for this processing, the GPU 2 may be required to perform two different rendering tasks, one to render the "application" frames as required and instructed by the application, and the other to then "time-warp" render those rendered frames appropriately based on the latest head orientation data into a buffer in memory for a reading out by the display controller 5 for display.

Figure 2:
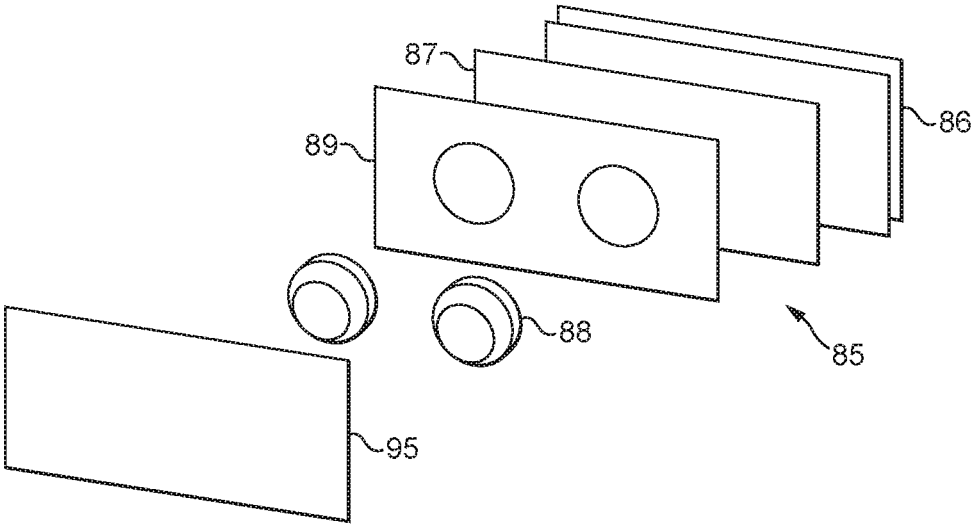
FIG. 2 shows schematically an exemplary virtual reality head mounted display headset.

FIG. 2 shows schematically an exemplary virtual reality head-mounted display 85. As shown in FIG. 2, the head-mounted display 85 comprises, for example, an appropriate display mount 86 that includes one or more head pose tracking sensors, to which a display screen (panel) 87 is mounted. A pair of lenses 88 is mounted in a lens mount 89 in the viewing path of the display screen 87. Finally, there is an appropriate fitting 95 for the user to wear the headset.

In the system shown in FIG. 1, the display controller 5 will operate to provide appropriate images to the display 4 (i.e. corresponding to the display screen 87 shown in FIG. 2) for viewing by the user. The display controller 5 may be coupled to the display 4 in a wired or wireless manner, as desired.

Images to be displayed on the head-mounted display 4 will be, e.g., rendered by the graphics processor (GPU) 2 in response to requests for such rendering from an application 10 executing on a host processor (CPU) 7 of the overall data processing system and store those frames in the main memory 3. In some embodiments of the technology described herein, the display controller 5 will then read the frames from memory 3 as input surfaces and provide those frames appropriately to the display 4 for display to the user.

In the present embodiment, and in the technology described herein, the GPU 2 or the display controller 5 is operable to be able to perform so-called "time-warp" processing on the frames stored in the memory 3 before providing those frames to the display 4 for display to a user.

Figure 3:
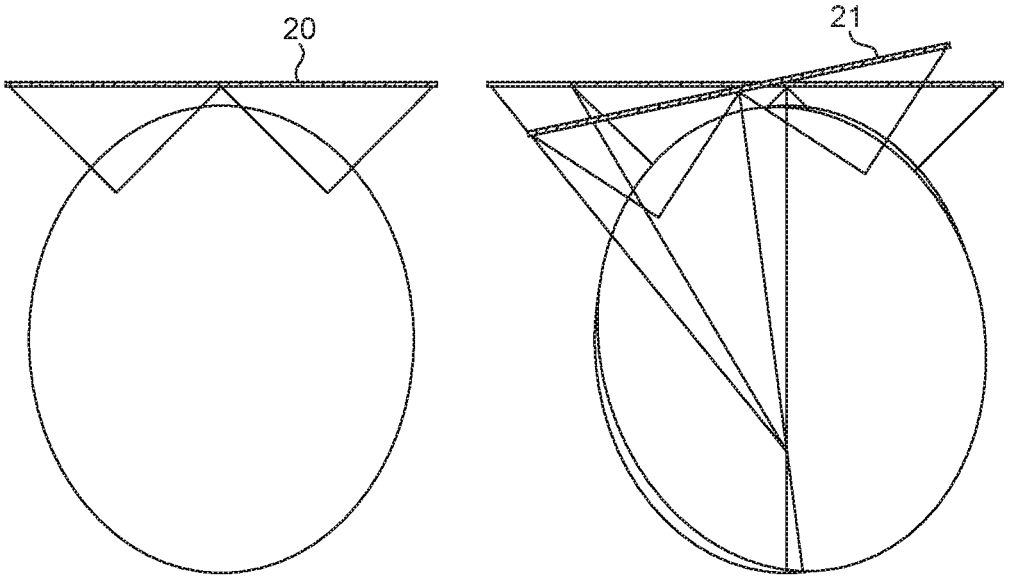
FIGS. 3 and 4 illustrate the process of "time-warp" rendering in a head mounted virtual reality display system.
Figure 4:
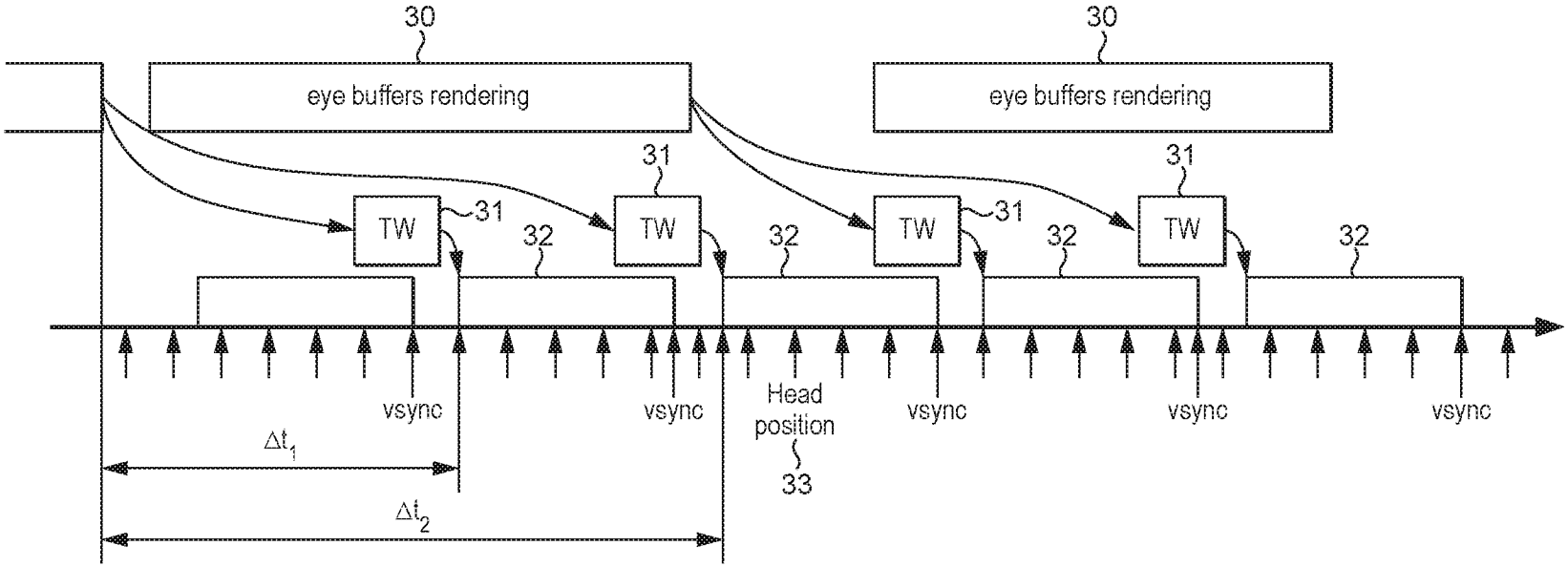
Figure 5:
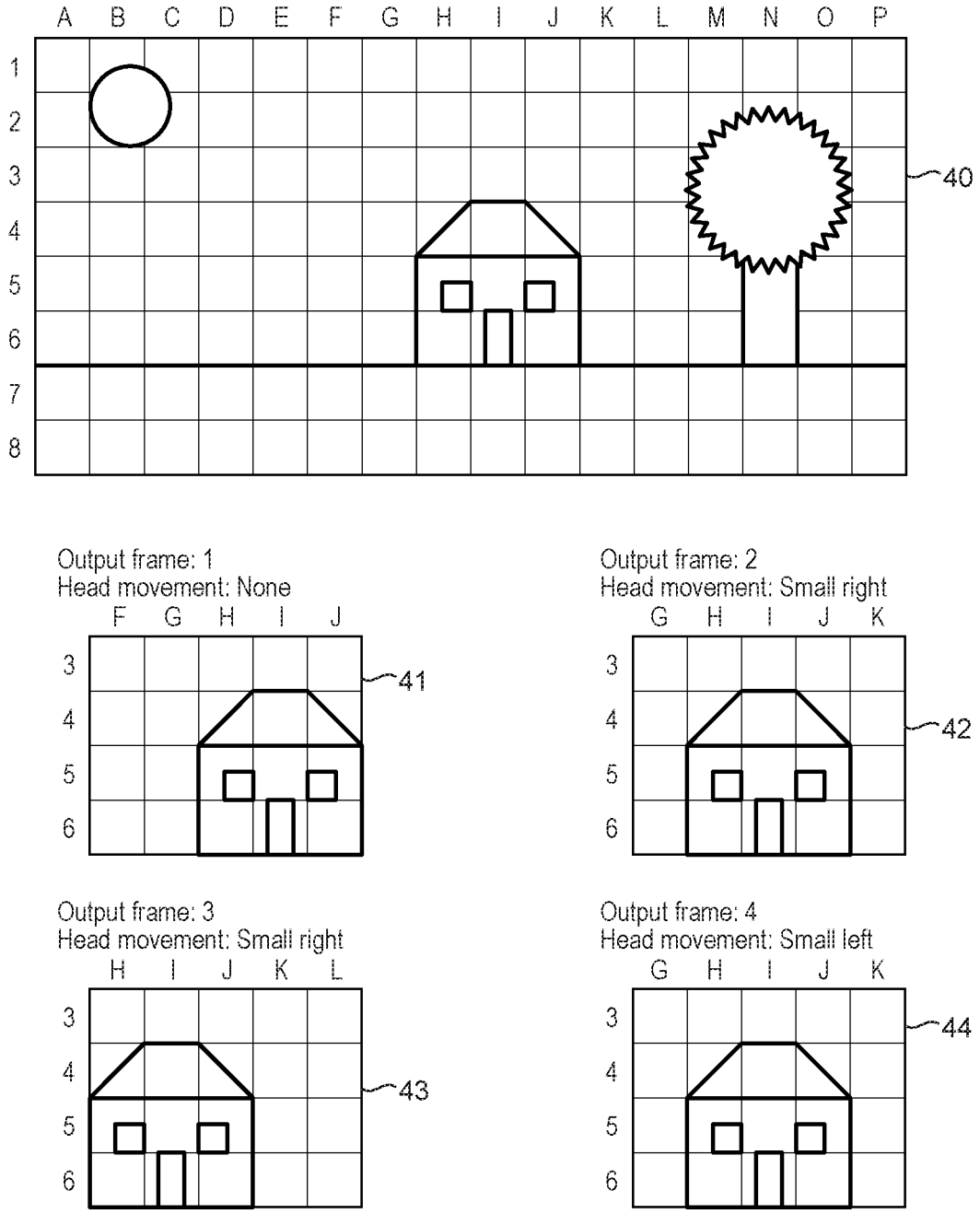
FIGS. 5 and 6 show schematically the generation of "time-warped" output surfaces for display.
Figure 6:
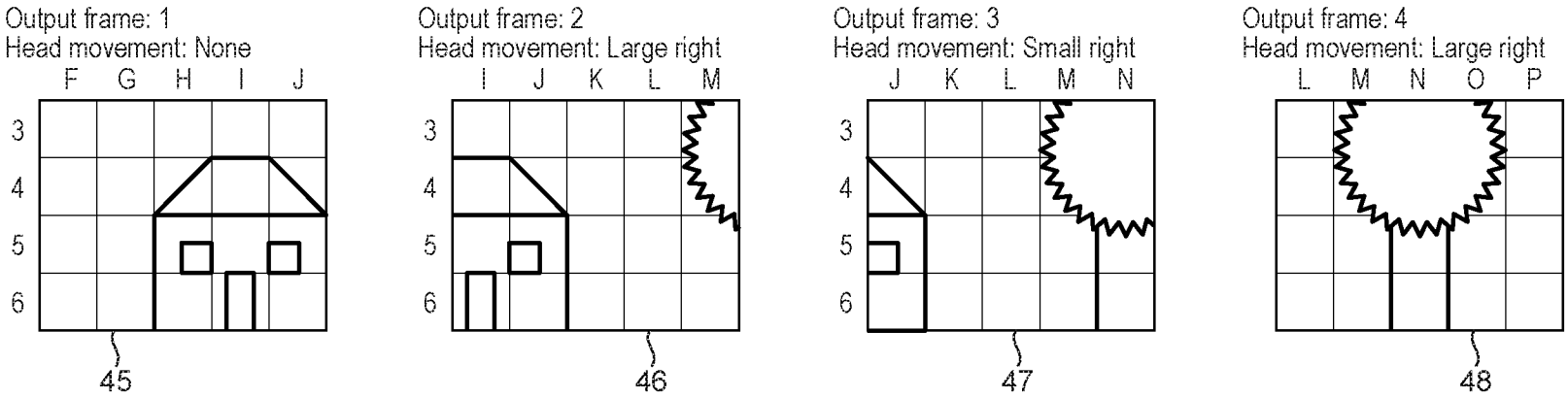

FIGS. 3 and 4 illustrate the "time-warp" process, e.g. to produce the output frames shown in FIGS. 5 and 6 from the input frame shown in FIG. 5.

FIG. 3 shows the display of an exemplary frame 20 when the viewer is looking straight ahead, and the required "time-warp" projection of that frame 21 when the viewing angle of the user changes. It can be seen from FIG. 3 that for the frame 21, a modified version of the frame 20 must be displayed.

FIG. 4 correspondingly shows the time-warp rendering 31 of application frames 30 to provide the "time-warped" frames 32 for display. As shown in FIG. 4, a given application frame 30 that has been rendered may be subject to two (or more, in some embodiments) time-warp processes 31 for the purpose of displaying the appropriate "time-warped" version 32 of that application 30 frame at successive intervals whilst waiting for a new application frame to be rendered. FIG. 4 also shows the regular sampling 33 of the head position (pose) data that is used to determine the appropriate "time-warp" modification that should be applied to an application frame 30 for displaying the frame appropriately to the user based on their head position.

Examples of "time-warping" an initial (application), input frame to provide the "time-warped" output frames for display are shown in FIGS. 5 and 6. FIGS. 5 and 6 show schematically the generation of "time-warped" output frames 41, 42, 43, 44, 45, 46, 47, 48 for display from an input frame 41 in an embodiment of the technology described herein. As is shown in FIGS. 5 and 6, in embodiments of the technology described herein, in order to accommodate reasonable anticipated head movements by the user over the time period between consecutive input frames being generated (i.e. during which the "time-warped" output frames are generated), the input frame 40 is generated over a larger area than the "time-warped" output frames 41, 42, 43, 44, 45, 46, 47, 48 for display.

FIG. 5 shows an input frame 40 (that has, e.g., been generated by a GPU and written to a frame buffer) of an image that has been rendered for display, with the view of the image being generated based on the head position (pose) data that is supplied at the time of generating the input frame 40. The input frame 40 has been generated in blocks of pixels, i.e. in blocks of 16 columns and 8 rows.

FIG. 5 also shows a series of four consecutive "time-warped" output frames 41, 42, 43, 44 that have been generated using a "time-warp" process, e.g. as illustrated in FIG. 4. Thus, in this example, for each input frame 40 generated, four time-warped output frames 41, 42, 43, 44 are generated. As can be seen, the output frames 41, 42, 43, 44 are smaller than the input frame 40 (i.e. blocks of 5 columns and 4 rows) and are selected from the central region of the input frame 40 in the direction in which the user is viewing the image.

Thus, for the first output frame 41, when the head position data indicates that the user has not noticeably moved their head from its position when the input frame 40 was generated, the output frame 41 is selected from the central region (columns F-J and rows 3-6) of the input frame 40. For the second output frame 42, the head position data indicates that the user has moved their head a small amount to the right, such that their gaze is directed one block to the right in the input frame 40. As such, the second output frame 42 is selected such that it is centred on this region (columns G-K and rows 3-6). For the third output frame 43 there has again been a small head movement to the right, such that the third output frame 43 is selected from columns H-L and rows 3-6 of the input frame 40. Finally, for the fourth output frame 44, there has been a small head movement back to the left detected, such that the fourth output frame 44 is the same as the second output frame 42, i.e. selected from columns G-K and rows 3-6.

FIG. 6 similarly shows a series of four consecutive "time-warped" output frames 45, 46, 47, 48 that also have been generated using a "time-warp" process for the input frame 40 shown in FIG. 5. FIG. 6 shows the scenario, starting from the same input frame 40 shown in FIG. 5, but with different amounts of head movement to that illustrated for the output frames 41, 42, 43, 44 shown in FIG. 5.

The output frames 45, 46, 47, 48 shown in FIG. 6 (which, e.g., have been generated by the same VR HMD system) are the same size as the output frames 41, 42, 43, 44 shown in FIG. 5 (i.e. blocks of 5 columns and 4 rows) and are selected from the central region of the input frame 40 in the direction in which the user is viewing the image.

Thus, for the first output frame 45, when the head position data indicates that the user has not noticeably moved their head from its position when the input frame 40 was generated, the output frame 45 is selected from the central region (columns F-J and rows 3-6) of the input frame 40. For the second output frame 46, the head position data indicates that the user has moved their head a large amount to the right, such that their gaze is directed three blocks to the right in the input frame 40. As such, the second output frame 46 is selected such that it is centred on this region (columns I-M and rows 3-6). For the third output frame 47 there has been detected only a small head movement to the right, such that the third output frame 47 is selected from columns J-N and rows 3-6 of the input frame 40. Finally, for the fourth output frame 44, there has been a further, large head movement to the right detected, such that the fourth output frame 48 is the same as the second output frame 42, i.e. selected from columns L-P and rows 3-6.

Figure 7:
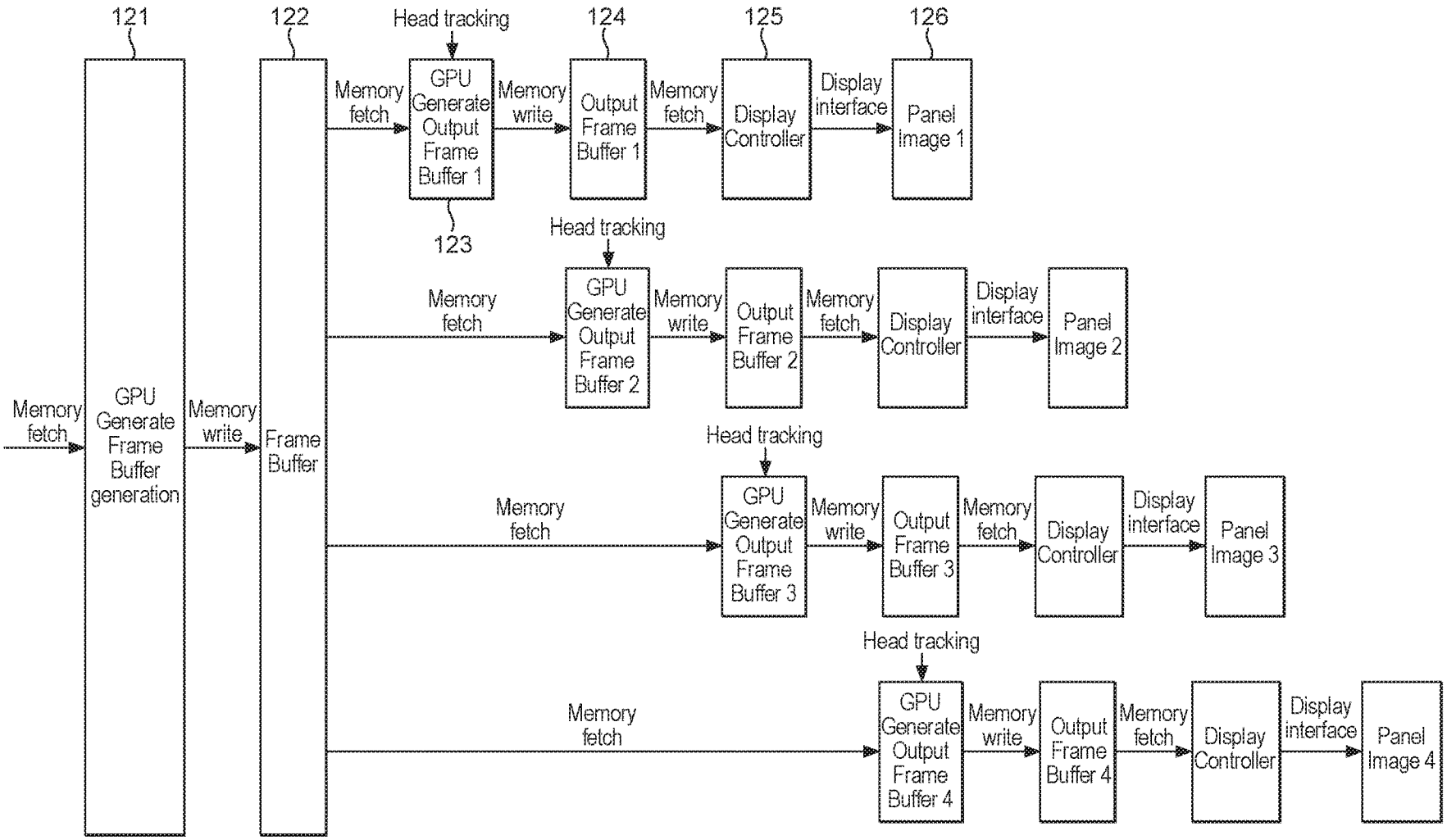
FIGS. 7 and 8 show the flow of data through the system shown in FIG. 1 when generating the output surfaces shown in FIGS. 5 and 6.
Figure 8:
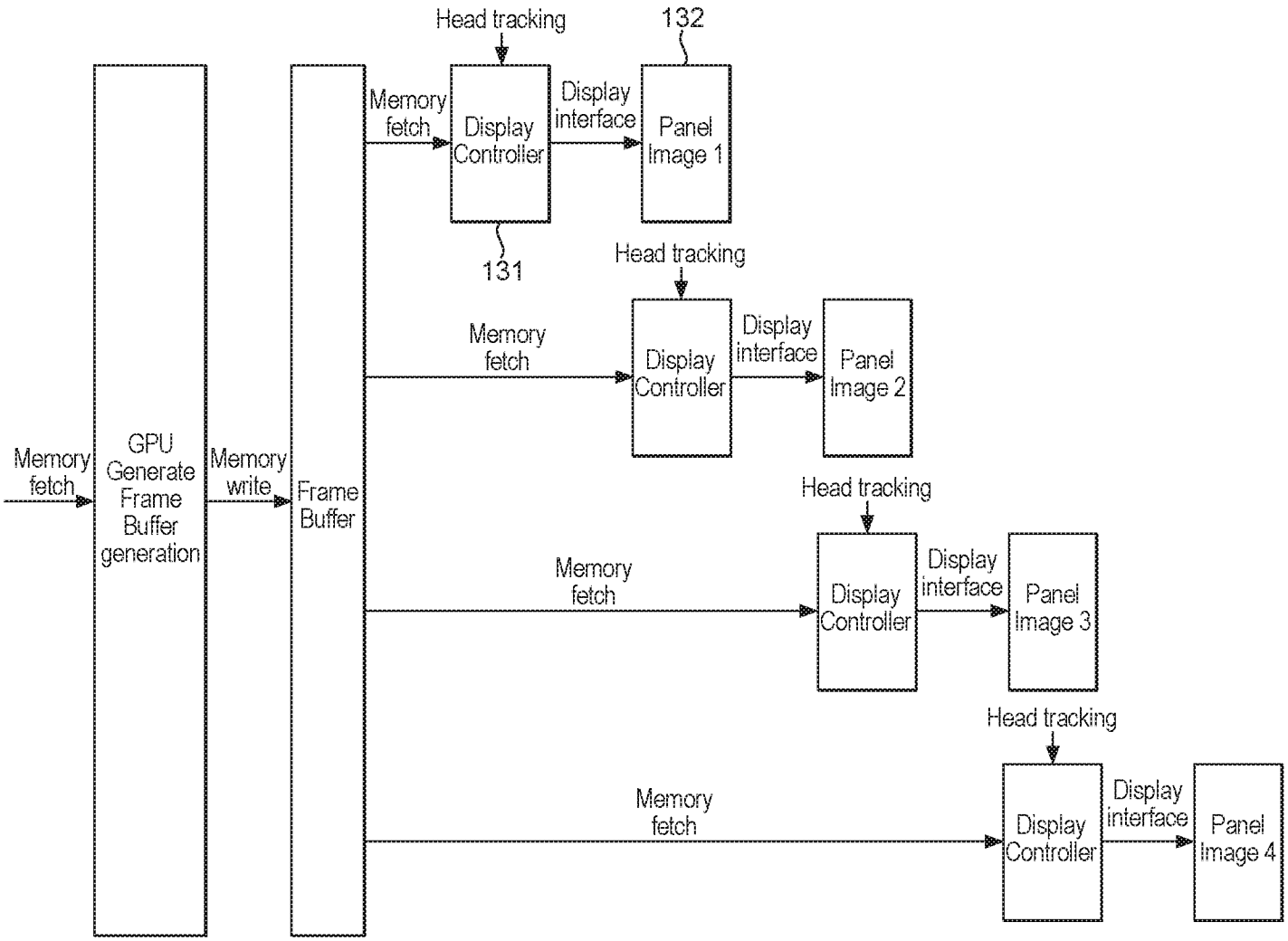

FIGS. 7 and 8 show the flow of data through the system shown in FIG. 1 when generating the time-warped output frames shown in FIGS. 5 and 6, in two different configurations of the system shown in FIG. 1. FIG. 7 shows the data flow when the GPU performs the time-warping process to generate the output frames; FIG. 8 shows the data flow when the display controller performs the time-warping process.

FIG. 7 shows, in the same manner as described above with reference to FIG. 1, that the input frame 40 (e.g. as shown in FIG. 5) is generated by the GPU 2 (e.g. as shown in FIG. 1), with the GPU 2 fetching the necessary data from memory (e.g. the off-chip memory 3 as shown in FIG. 1) to generate the input frame 40 (step 121, FIG. 7). The input frame 40 is then written into a frame buffer (e.g. located in the off-chip memory 3) (step 122, FIG. 7).

The GPU 2 then fetches the required portion of the input frame 40 from the frame buffer and generates the first output frame 41, 45 (e.g. as shown in FIG. 5 or 6), using the head pose data to select the part of the input frame 40 that the user's gaze is centred on (step 123, FIG. 7). This first output frame 41, 45 is then written to an output frame buffer (e.g. located in the off-chip memory 3) (step 124, FIG. 7), from where it is read by the display controller 5 (step 125, FIG. 7) and sent to the display 4 for viewing by the user (step 126, FIG. 7).

This process is repeated to generate the second output frame 42, 46, with the GPU 2 sampling the updated head pose data to select the relevant part of the input frame 40 to form the output frame 42, 46 for writing to the output frame buffer, from where it is read by the display controller 5 and sent to the display 4. In the same manner, the third output frame 43, 47 and the fourth output frame 44, 48 are generated by the GPU 2 at successive time intervals using the head pose data available at these respective times, with the output frames 43, 47, 44, 48 again being written to the output frame buffer and displayed by the display controller 5.

FIG. 8 shows a similar process of generating the input frame 40, generating and displaying the output frames 41, 42, 43, 44, 45, 46, 47, 48 as shown in FIG. 7, except that in the implementation shown in FIG. 8, the display controller 5 generates the output frames 41, 42, 43, 44, 45, 46, 47, 48 instead of the GPU 2 in the implementation shown in FIG. 7.

Thus, in the implementation shown in FIG. 8, the GPU 2 first generates the input frame 40 and writes it into the frame buffer (i.e. the same as in the implementation shown in FIG. 7). The display controller 5 then fetches the required portion of the input frame 40 from the frame buffer and generates the required output frame, using the head pose data to select the part of the input frame 40 that the user's gaze is centred on (step 131, FIG. 8). The output frame is then sent straight to the display 4 for viewing by the user (step 132, FIG. 8), i.e. unlike in the implementation shown in FIG. 7, the output frames do not first need to be written into an output frame buffer to then be read by the display controller for display.

Figure 9:
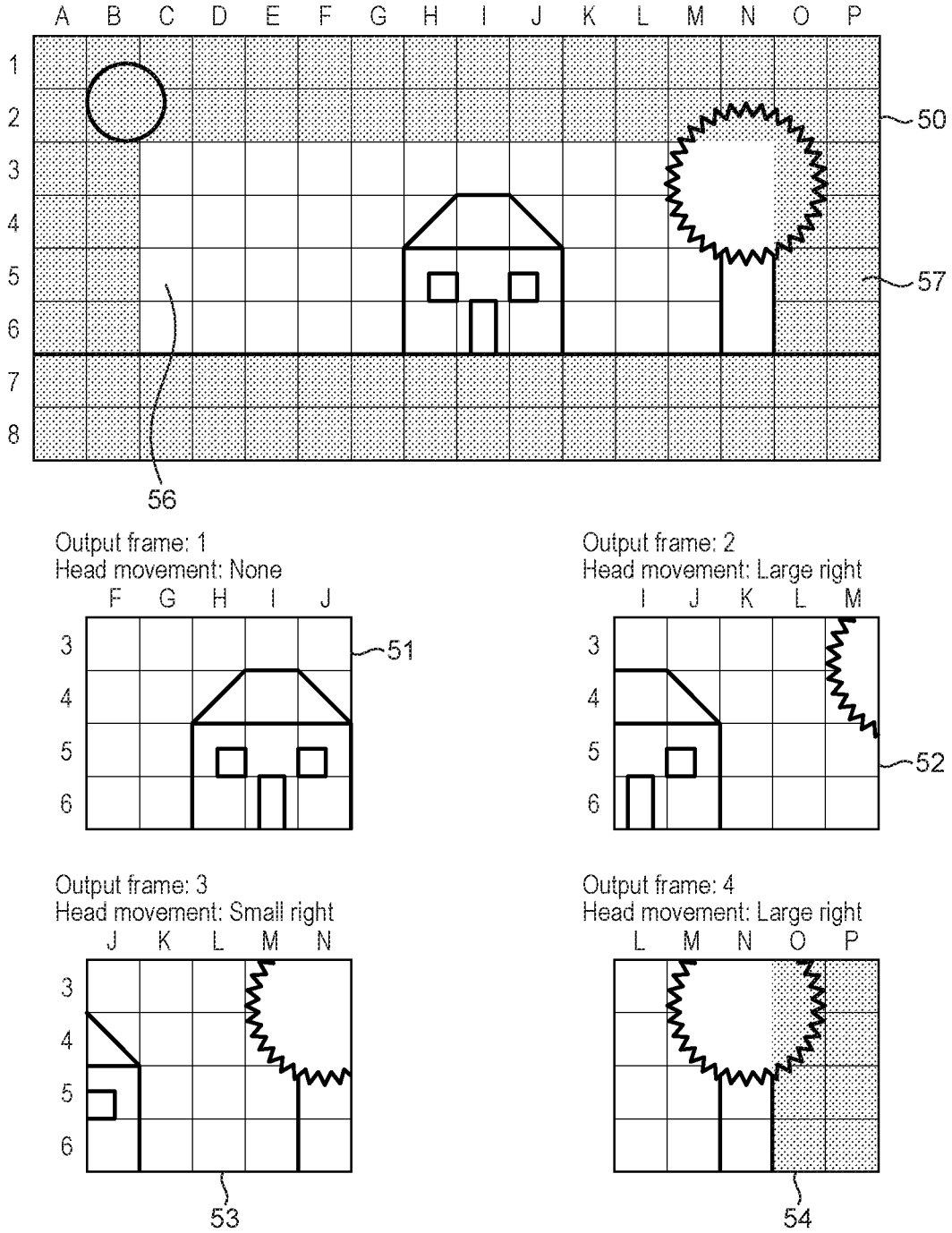
FIG. 9 shows schematically the generation of an input and output surfaces for display in an embodiment of the technology described herein.

Using the same approach as has been outlined above, an embodiment of the technology described herein will now be described with reference to FIGS. 9-11. FIG. 9, similar to FIG. 5, shows schematically the generation of an input frame 50 and four time-warped output frames 51, 52, 53, 54 that are selected from the input frame 50 for display. In this embodiment, the input frame 50 is generated with a central region 56 (the blocks that lie in both columns C-N and rows 3-6) having a high fidelity (e.g. high resolution) and a peripheral region 57 (the blocks that lie in columns A, B, O and P, and the blocks that lie in rows 1, 2, 7 and 8) having a low fidelity (e.g. low resolution).

A series of time-warped output frames 51, 52, 53, 54, selected from the input frame 50, are generated in the same way as described above in relation to FIGS. 5 and 6. Indeed the head movements detected in the output frames 51, 52, 53, 54 shown in FIG. 9 are the same as those shown in FIG. 6. However, it will be seen that owing to the large head movement to the right that has been detected when the fourth output frame 54 is selected from the input frame 50 in FIG. 9, this results in the fourth output frame 54 including some of low fidelity peripheral region 57 of the input frame 50. However, this is acceptable because of the large head movement which means that the user is unlikely to be able to notice the lower fidelity of this part of the output frame 54.

Figure 10:
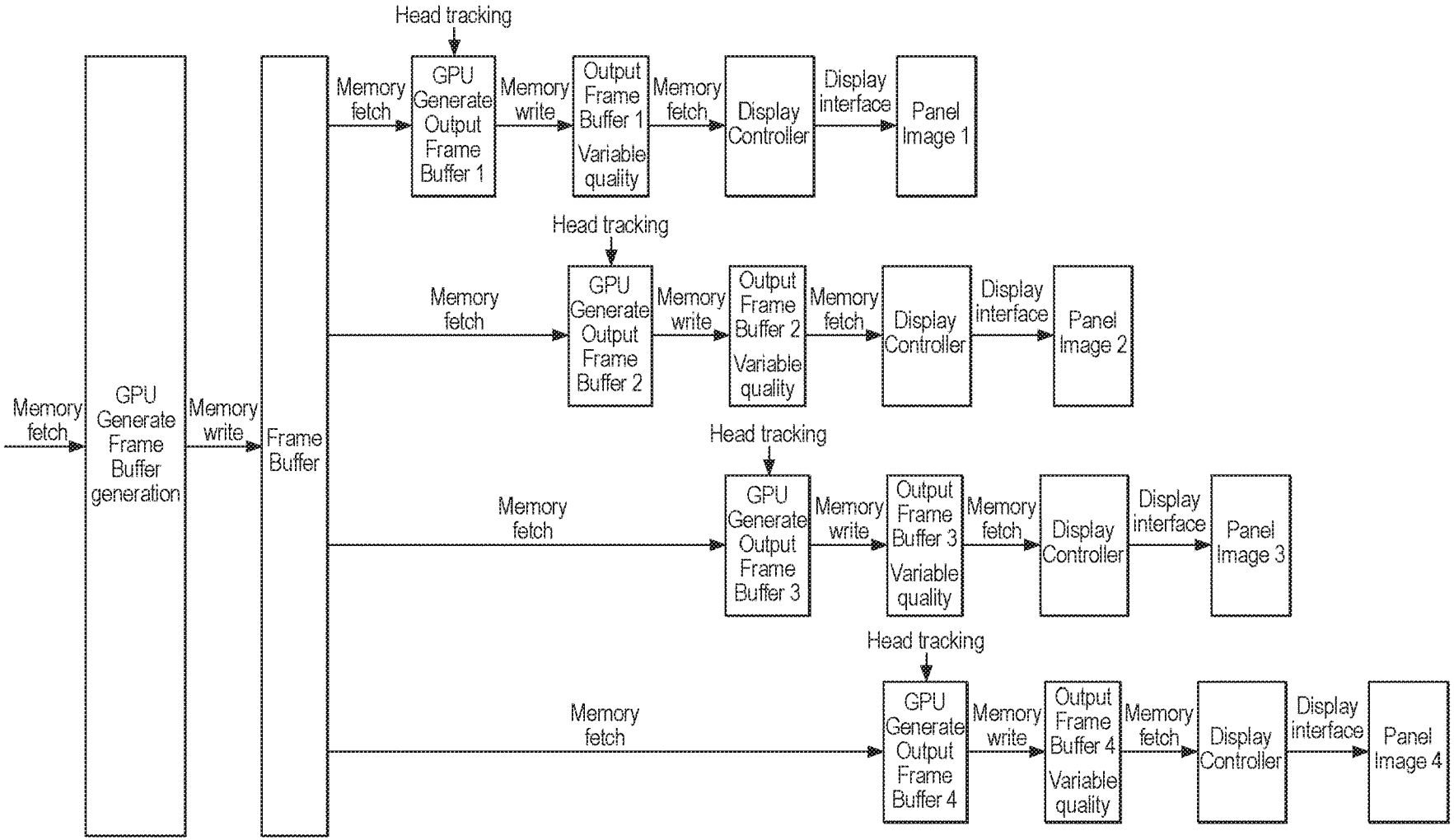
FIG. 10 shows the flow of data through the system shown in FIG. 1 when generating the input and output surfaces shown in FIG. 9.

FIG. 10 shows the data flow in one embodiment of the system (e.g. as shown in FIG. 1) that is used to generate the input and output frames 50, 51, 52, 53, 54 shown in FIG. 9. It will be seen that the configuration of the data flow shown in FIG. 10 is almost identical to the data flow shown in FIG. 7, i.e. with the GPU 2 generating the input frame 50 and then selecting the input frames 51, 52, 53, 54 for the display controller 5 to read from the output frame buffer and display. The only difference compared to the implementation shown in FIG. 7 is that the input frame 50 has a lower fidelity peripheral region 57 compared to the higher fidelity central region 56 (as opposed to the input frame 40 shown in FIG. 5 which is generated at the same fidelity across its whole extent).

Thus, as has been described above with reference to FIG. 9, when large head movements are detected, such that the user is viewing the edge of the image generated in the input frame 50, the output frame(s) (e.g. the fourth output frame 54 shown in FIG. 9) may include part of the lower fidelity peripheral region 57 and thus may have a variable fidelity.

Operation of this embodiment of the technology described herein will now be described with reference to FIG. 11. FIG. 11 is a flow chart that shows the operation of the system shown in FIG. 1, when implemented in the virtual reality head-mounted display 85 shown in FIG. 2, when generating the input and (time-warped) output surfaces 50, 51, 52, 53, 54 shown in FIG. 9 and using the data flow shown in FIG. 10.

Figure 11:
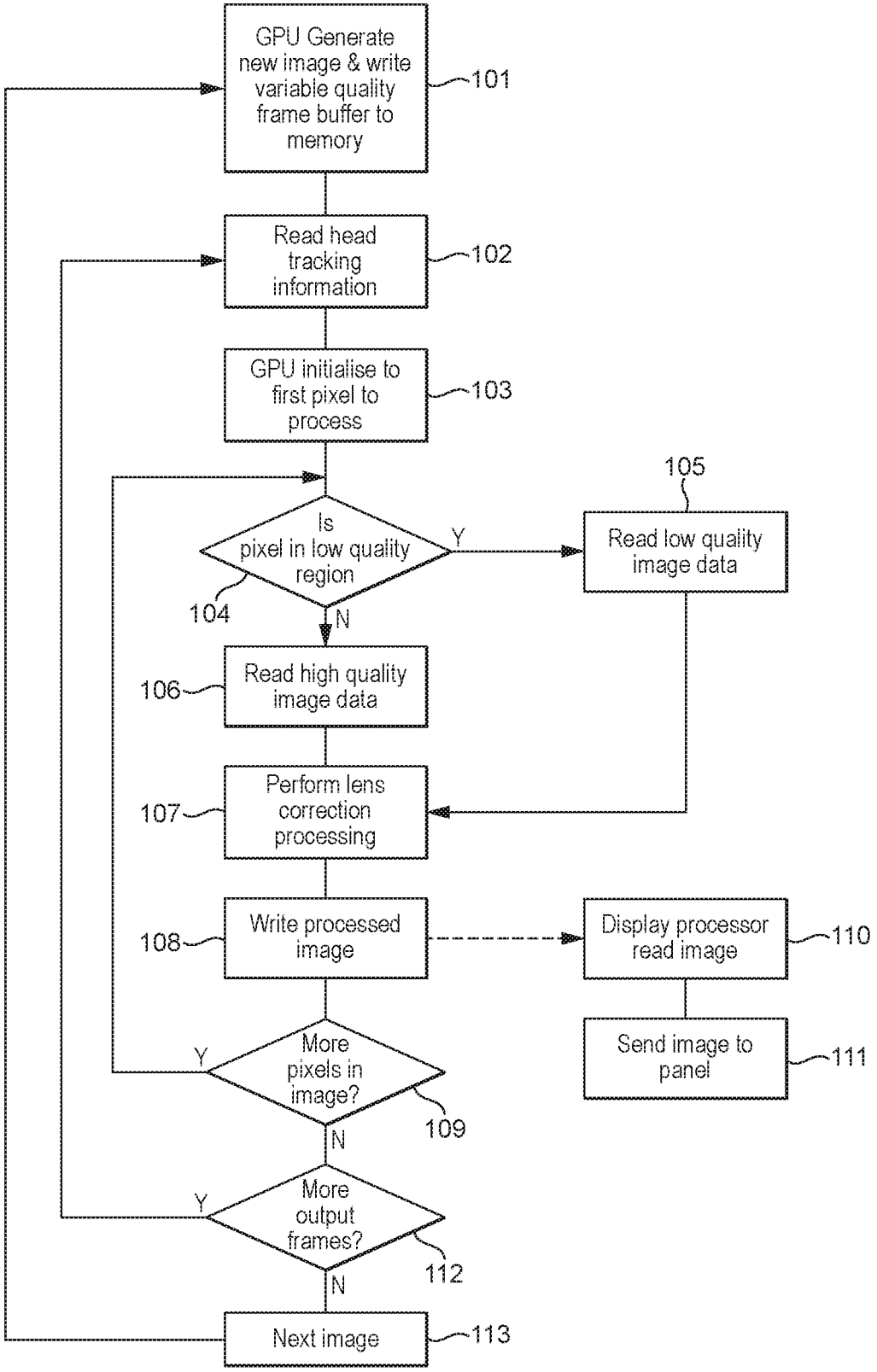
FIG. 11 is a flow chart that shows the operation of the system shown in FIG. 1 when generating the input and output surfaces shown in FIG. 9 and using the data flow shown in FIG. 10.

First, under instruction from an application 10 executing on the CPU 7, the GPU 2 generates a new input frame 50 having a high fidelity central region 56 and a low fidelity peripheral 57, and writes this input frame 50 to a frame buffer in the off-chip memory 3 (step 101, FIG. 11).

The head pose tracking sensors in the display mount 86 of the head-mounted display 85 detect any head movement of the user wearing the head-mounted display 85, and the head pose tracking data output by these sensors is read by the GPU 2 (step 102, FIG. 11). Based on this head pose data (i.e. indicating towards which part of the input frame 50 the user is looking), the GPU 2 determines the part of the input frame 50 that is to be selected as the first time-warped output frame 51 and thus is initialised to process the first pixel of this output frame 51 (step 103, FIG. 11).

The GPU 2 then determines when the first pixel is within the low fidelity peripheral region 57 of the input frame 50 (step 104, FIG. 11) and, if so, reads the relevant low fidelity image data for this pixel from the frame buffer of the input frame 50 (step 105, FIG. 11). Alternatively, when the pixel is within the high fidelity central region 56, the GPU 2 reads the relevant high fidelity image data for this pixel (step 106, FIG. 11).

Once the relevant low or high fidelity image data has been read for the pixel, lens correction processing is performed on the image data (step 107, FIG. 11), following which the lens corrected image data for the output frame 51 is written to an output frame buffer (step 108, FIG. 11).

If there are more pixels in the output frame 51 to be processed (step 109, FIG. 11), the GPU 2 assesses when the next pixel is in the low fidelity peripheral region 57 of the input frame 51 (step 104, FIG. 11) and the steps of reading the appropriate image data (steps 105, 106, FIG. 11), performing the lens correction processing (step 107, FIG. 11) and writing the processed image data to the output frame buffer (step 108, FIG. 11) are repeated for each of these pixels in turn.

The image data written out for the output frame 51 can then be read by the display controller 5 (step 110, FIG. 11), with the display controller 5 then sending the output frame 51 to the display panel 4 (step 111, FIG. 11).

Once an output frame 51 has been generated (and subsequently displayed), and there are more output frames to be generated before the next input frame is scheduled to be generated (step 112, FIG. 11), the next output frame 52 is generated in the same manner, using the latest available head pose data (steps 102-111, FIG. 11). This process is repeated for each of the output frames 53, 54 to be generated until a new input frame is to be generated (step 113, FIG. 11).

When it is time for the next input frame to be generated, the whole process, starting with the GPU 2 generating the new input frame (step 101, FIG. 11), is repeated in order to produce the time-warped output frames for this input frame (steps 102-112, FIG. 11).

Figure 12:
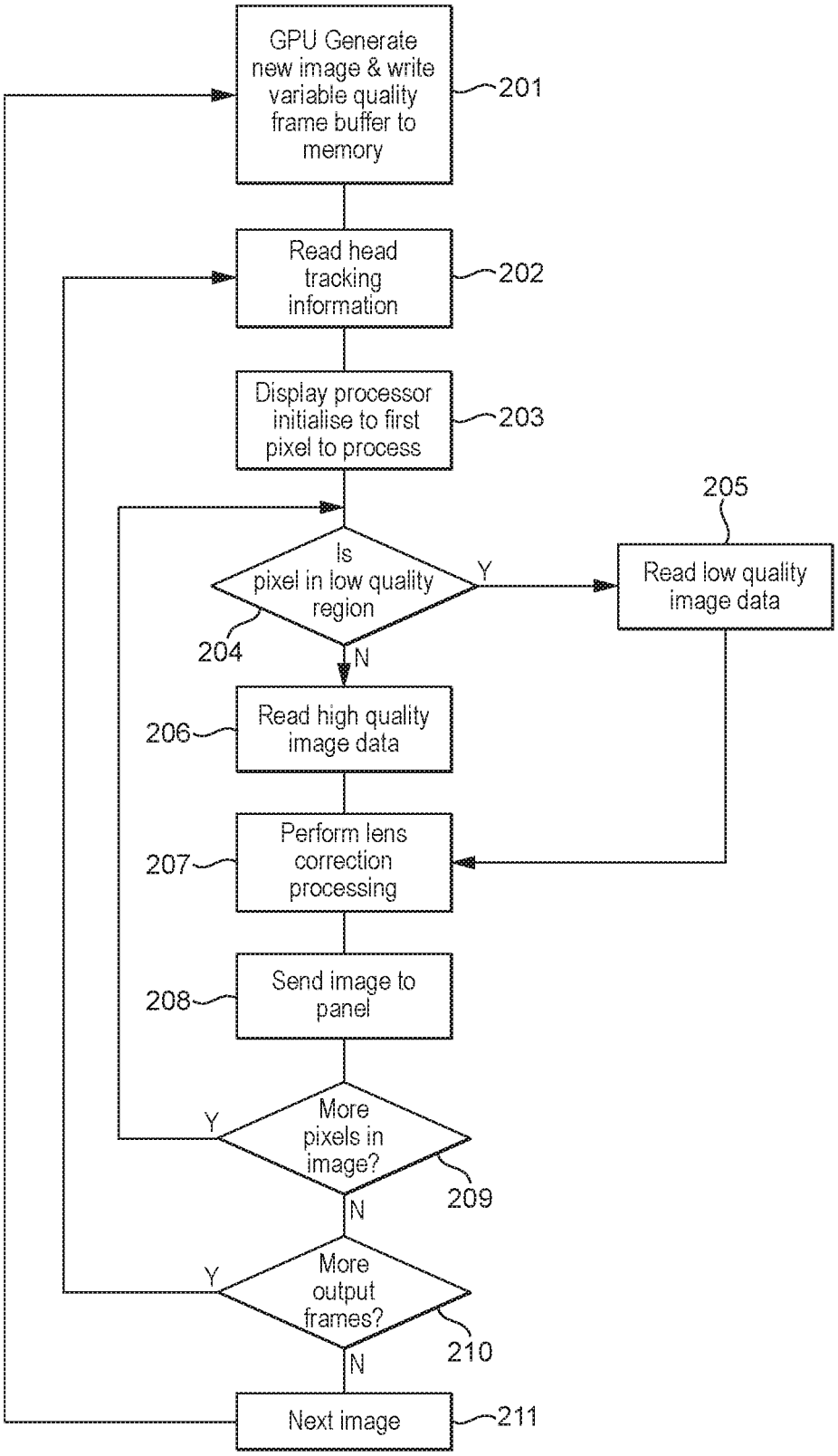
FIG. 12 is a flow chart that shows the operation of the system shown in FIG. 1 when generating the input and output surfaces shown in FIG. 9 in another embodiment of the technology described herein.

Operation of another embodiment of the technology described herein will now be described with reference to FIG. 12. FIG. 12 is a flow chart that shows the operation of the system shown in FIG. 1, when implemented in the virtual reality head-mounted display 85 shown in FIG. 2, when generating the input and (time-warped) output surfaces 50, 51, 52, 53, 54 shown in FIG. 9.

The operation of the embodiment shown in FIG. 12 is similar to the embodiment shown in FIG. 11, except that the display controller 5 generates the output frames 51, 52, 53, 54 from the input frame 50, rather than the GPU 2 as in the embodiment of FIG. 11. Thus, the data flow for the embodiment shown in FIG. 12 is almost identical to the data flow shown in FIG. 8, except that the input frame 50 has a lower fidelity peripheral region 57 compared to the higher fidelity central region 56 (as opposed to the input frame 40 shown in FIG. 5 which is generated at the same fidelity across its whole extent).

Thus, exactly the same as in the embodiment shown in FIG. 11, the GPU 2 generates a new input frame 50 having a high fidelity central region 56 and a low fidelity peripheral 57, and writes this input frame 50 to a frame buffer in the off-chip memory 3 (step 201, FIG. 12).

However, when it comes to reading the head pose tracking data (step 202, FIG. 12) and initialising to process the first pixel of this output frame 51 (step 203, FIG. 12), this is performed by the display controller 5. The display controller 5 thus then determines when the first pixel is within the low fidelity peripheral region 57 or the high fidelity central region 56 (step 204, FIG. 12) and reads the relevant low or high fidelity image data for this pixel from the frame buffer of the input frame 50 (steps 205, 206, FIG. 12). The display controller 5 also then performs the necessary lens correction processing for the image data that has been read (step 207, FIG. 12).

As the display controller 5 has generated the output frame 51, the image data can be sent straight to the display 4 (step 208, FIG. 12), i.e. rather than the GPU 2 writing the image data to the output frame buffer from where it is read and displayed by the display controller 5.

The process is then repeated for further pixels in the output frame 51 (step 209, FIG. 12) and for each of the output frames 52, 53, 54 (step 210, FIG. 12) before the next input frame is generated by the GPU 2 (step 211, FIG. 12).

Figure 13:
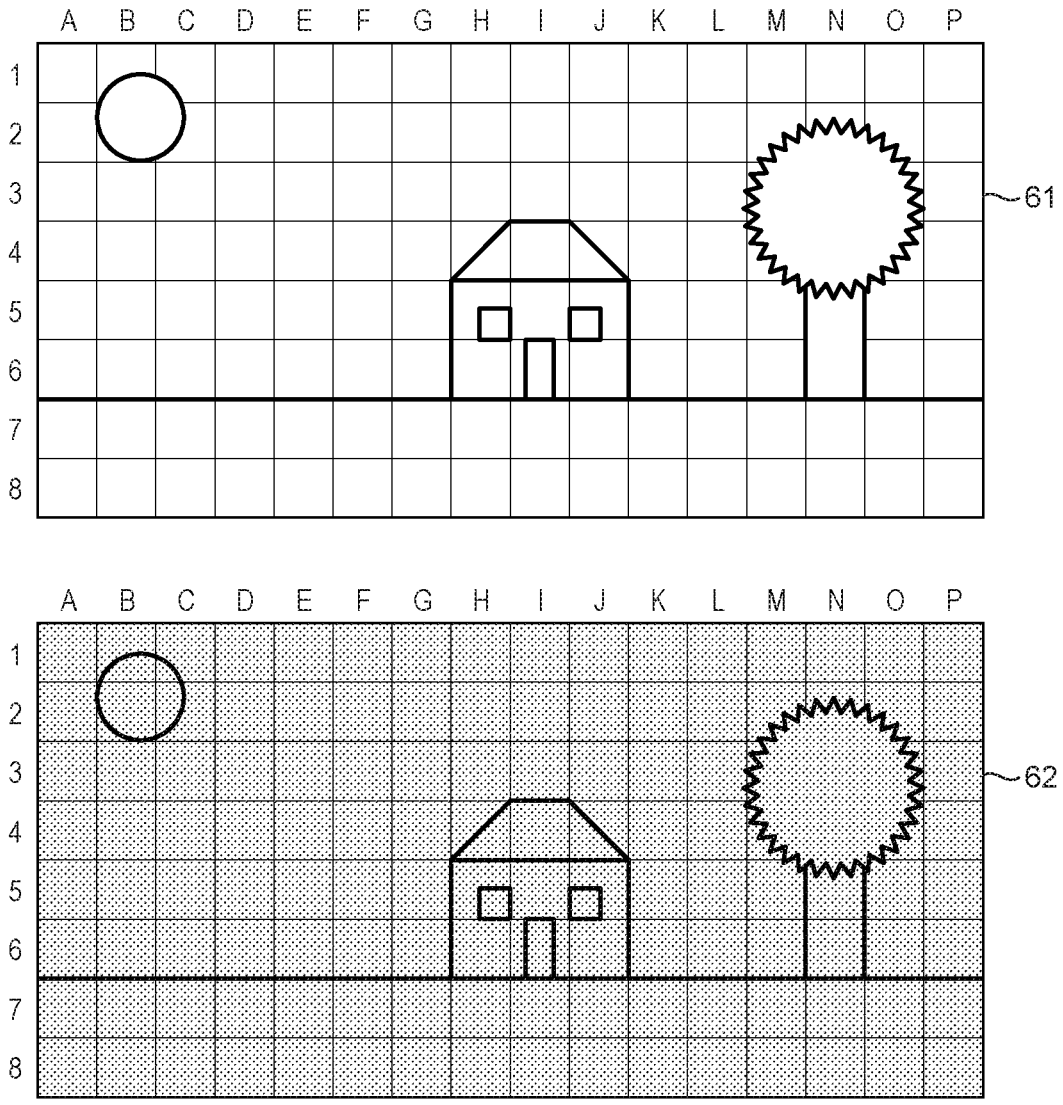
FIG. 13 shows schematically the generation of input surfaces in an embodiment of the technology described herein.

Another embodiment of the technology described herein will now be described with reference to FIGS. 13 and 14. FIG. 13, similar to FIG. 9, shows schematically the generation of two input frames 61, 62 from which the time-warped output frames 51, 52, 53, 54 (as shown in FIG. 9) can be generated for display. In this embodiment, instead of a single input frame 50 with a lower fidelity periphery being generated (i.e. as shown in FIG. 9), two input frames 61, 62 are generated: a higher fidelity input frame 61 and a lower fidelity version 62 of the input frame.

The lower fidelity input frame 62 may, for example, be generated by compressing the higher fidelity input frame 61 when writing out the input frames 61, 62 to a frame buffer (e.g. using the frame buffer compression technique described in the Applicant's U.S. Pat. No. 8,542,939 B2, U.S. Pat. No. 9,014,496 B2, U.S. Pat. No. 8,990,518 B2 and U.S. Pat. No. 9,116,790 B2). Thus the higher fidelity input frame 61 and the lower fidelity input frame 62 both show the same image, just at different levels of fidelity.

In a variant to this embodiment, only a central region of the higher fidelity input frame 61 is generated and/or written out to a frame buffer, such that the lower fidelity input frame 62 is larger than the higher fidelity input frame 61. For example, the higher fidelity input frame 61 may correspond to the central region 56 of the input frame 50 shown in FIG. 9.

Figure 14:
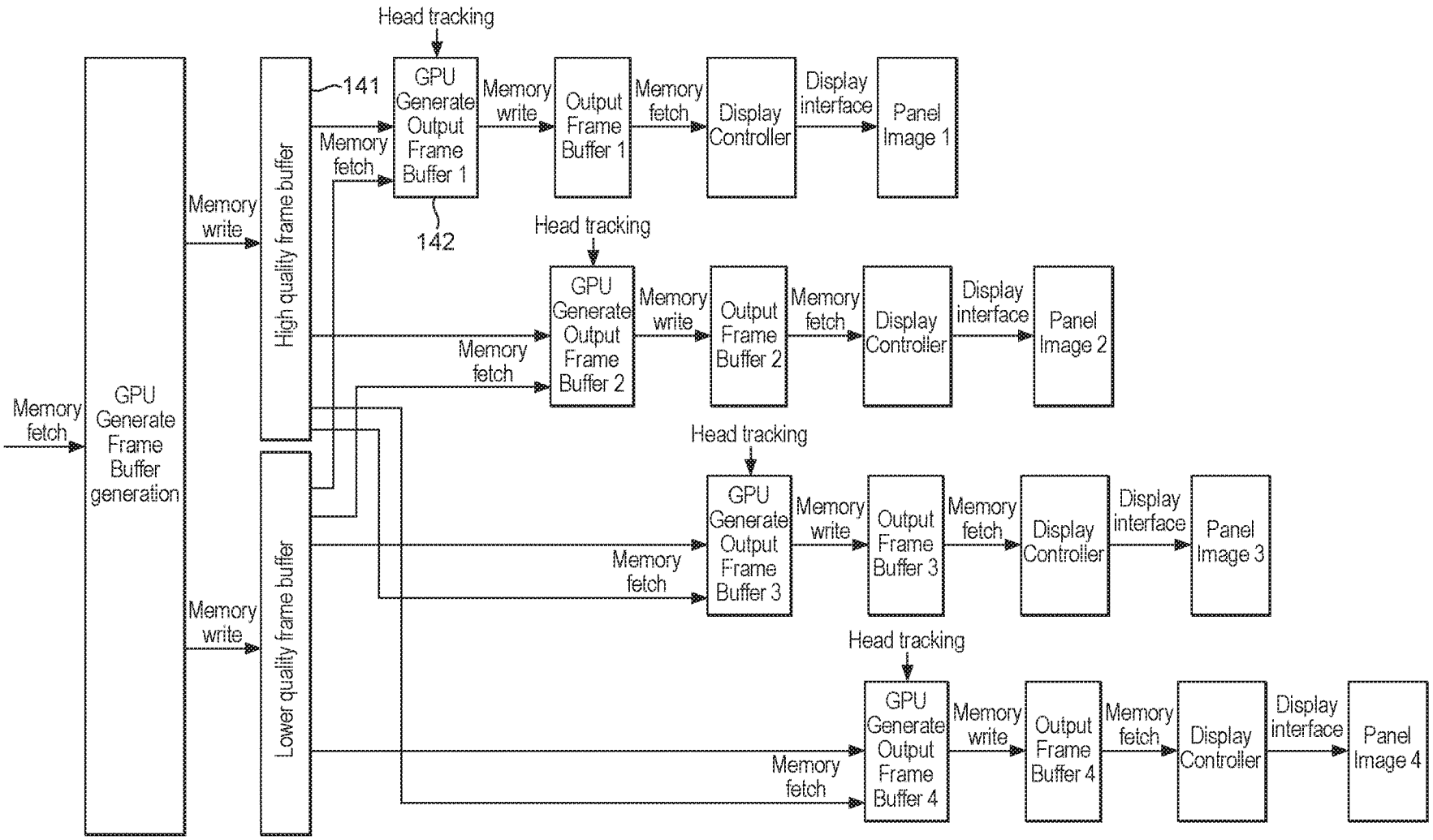
FIGS. 14 and 15 show the flow of data through the system shown in FIG. 1 when generating the output surfaces shown in FIG. 9 from the input surfaces in FIG. 13.

FIG. 14 shows the flow of data through the system shown in FIG. 1 when generating the output surfaces 51, 52, 53, 54 shown in FIG. 9 from the input surfaces 61, 62 in FIG. 13. The data flow shown in FIG. 14 is similar to the data flow shown in FIG. 10, except that the GPU 2 generates two input frames 61, 62 and writes these to separate frame buffers (step 141, FIG. 14). The GPU 2 then generates the output surfaces 51, 52, 53, 54 in a similar way, except that it selectively reads the image data from either or both of the frame buffers for the higher fidelity input frame 61 and the lower fidelity input frame 62, when generating each of the time-warped output surfaces 51, 52, 53, 54 (step 142, FIG. 14).

Figure 15:
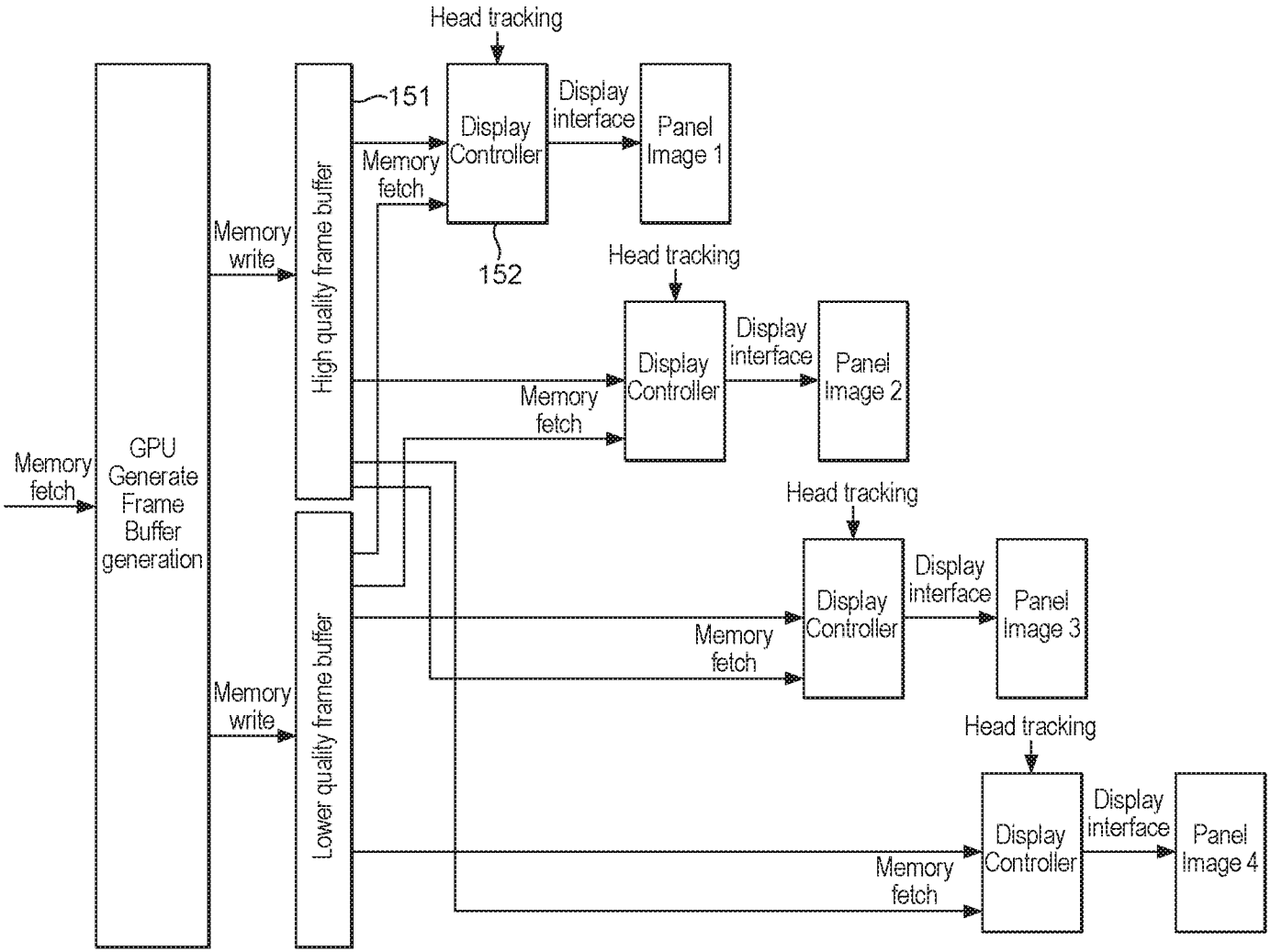

FIG. 15 shows the flow of data through the system shown in FIG. 1 when generating the output surfaces 51, 52, 53, 54 shown in FIG. 9 from the input surfaces 61, 62 in FIG. 13 in a different embodiment of the technology described herein. Thus FIG. 15 shows a similar process of generating the input frames 61, 62, generating and displaying the output frames 51, 52, 53, 54 to the process shown in FIG. 14, except that in the embodiment shown in FIG. 15, the display controller 5 generates the output frames 51, 52, 53, 54 instead of the GPU 2 in the embodiment shown in FIG. 14. Thus the data flow shown in FIG. 15 is similar to the data flow shown in FIG. 8, except that the GPU 2 generates two input frames 61, 62 and writes these to separate frame buffers (step 151, FIG. 15), i.e. from which the display controller 5 selectively reads the image data when generating each of the time-warped output surfaces 51, 52, 53, 54 (step 152, FIG. 15).

Figure 16A:
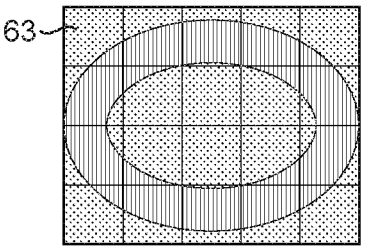
FIGS. 16*a*, 16*b*, 16*c* and 17 show schematically the generation of output surfaces taking into account lens distortion.
Figure 16B:
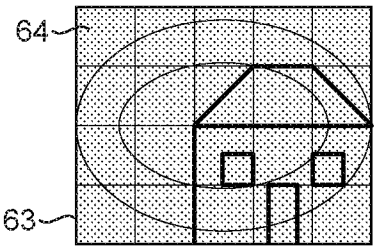
Figure 16C:
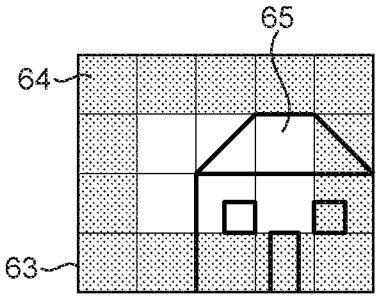

FIGS. 16*a*, 16*b*, 16*c* and 17 show schematically the generation of output frames when taking into account lens distortion. FIGS. 16*a*, 16*b*, 16*c* show schematically the effect of lens distortion on an output frame, e.g. for a user viewing an output frame on the display screen 87 through the lenses 88 of the head-mounted display 85 shown in FIG. 2.

FIG. 16*a* shows schematically the distortion over the area of an output frame 63 that a lens may create. It will be seen that there is increased, e.g. barrel, distortion around the edges of the output frame. FIG. 16*b* shows the distortion shown in FIG. 16*a* superimposed over an output frame 63. From this it can be seen that the lens distortion primarily affects the peripheral blocks 64 of the output frame 63. FIG. 16*c* shows that, in an embodiment of the technology described herein, owing to the lens distortion (i.e. as shown in FIGS. 16*a* and 16*b*) the peripheral blocks 64 of the output frame 63 are selected from the lower fidelity input frame 62 shown in FIG. 13 and the blocks in the central region 65 of the output frame 63 are selected from the higher fidelity input frame 61 shown in FIG. 13.

Figure 17:
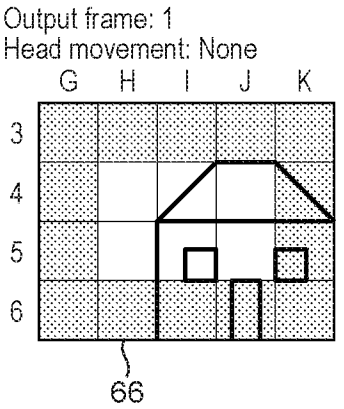
Figure 17:
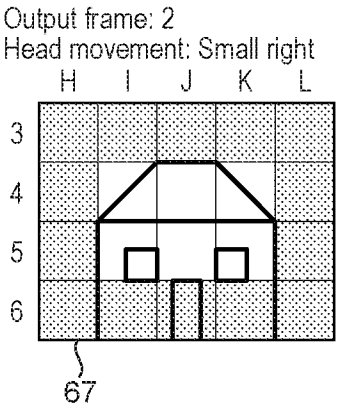
Figure 17:
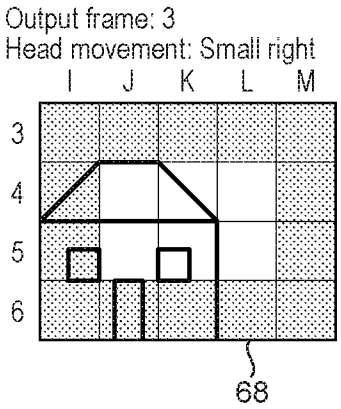
Figure 17:
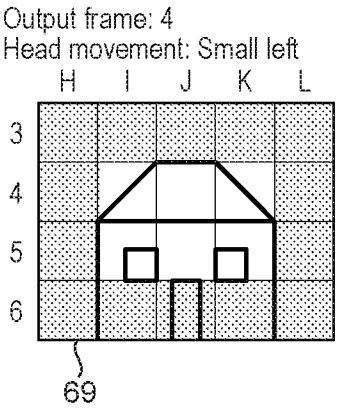

FIG. 17 shows the effect of selecting the peripheral region of an output frame from a lower fidelity input frame, owing to the lens distortion shown in FIGS. 16*a*, 16*b* and 16*c*, for a series of four time-warped output frames 66, 67, 68, 69. The output frames 66, 67, 68, 69 are generated from the low and high fidelity input frames 61, 62 shown in FIG. 13, with each output frame 66, 67, 68, 69 being selected from the input frames 61, 62 based on the head position data that is received at the time of generating each output frame 66, 67, 68, 69 (i.e. in the same manner in which the time-warped output frames 41, 42, 43, 44 were selected, based on the head movement, from the input frame 40 shown in FIG. 5).

However, for the output frame 66, 67, 68, 69 generated and shown in FIG. 17, the blocks in the peripheral region of each output frame 66, 67, 68, 69 are selected from the corresponding blocks of the lower fidelity input frame 62 shown in FIG. 13 and the blocks in the central region of each output frame 66, 67, 68, 69 are selected from the corresponding blocks of the higher fidelity input frame 61 shown in FIG. 13.

Figure 18:
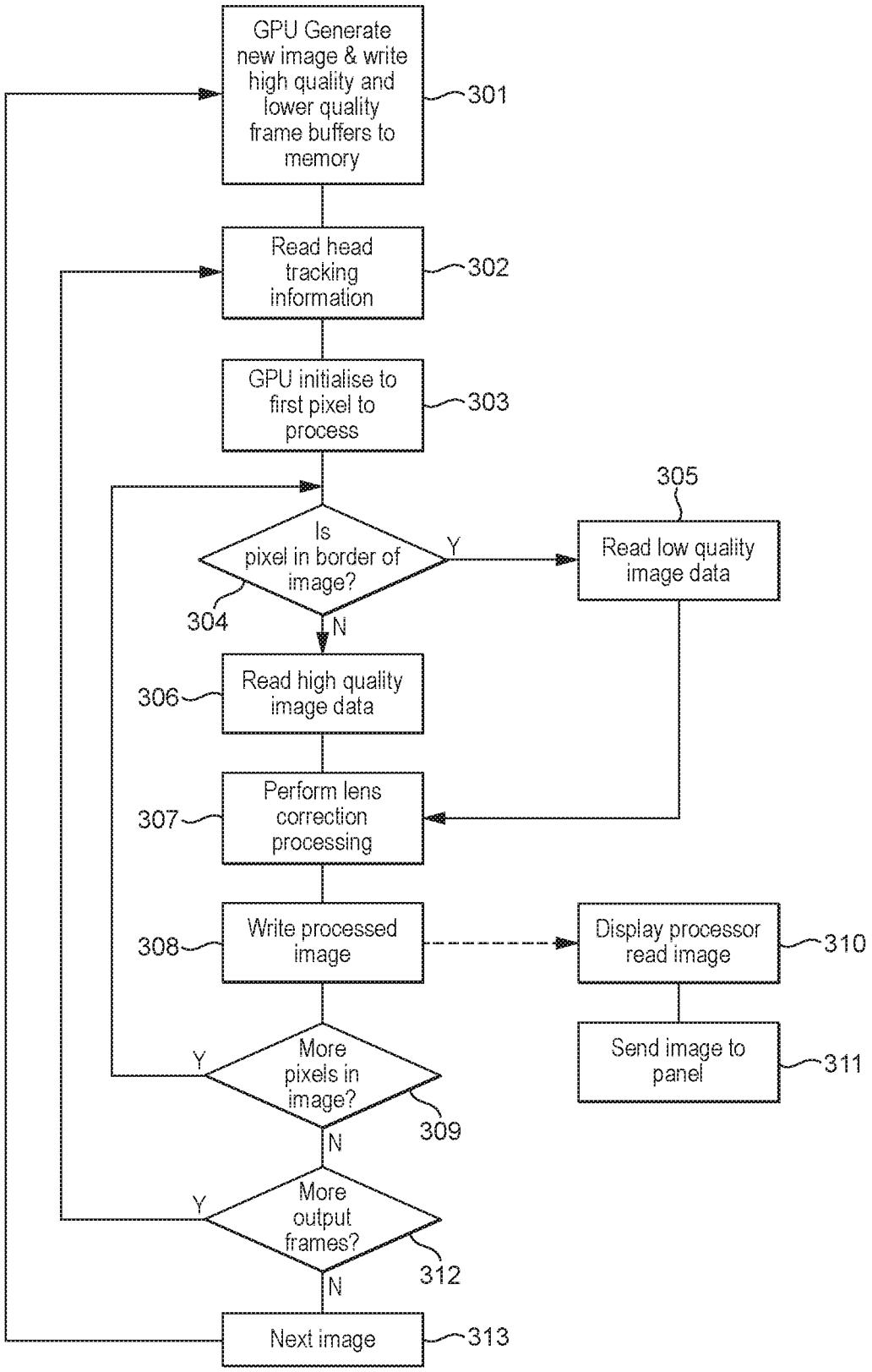
FIG. 18 is a flow chart that shows the operation of the system shown in FIG. 1 when generating the input surfaces shown in FIG. 13, the output surfaces shown in FIG. 17 and using the data flow shown in FIG. 14 in another embodiment of the technology described herein.

Operation of the generation of the output frames 66, 67, 68, 69 shown in FIG. 17 will now be described with reference to FIG. 18. FIG. 18 is a flow chart that shows the operation of the system shown in FIG. 1 when generating the input surfaces shown in FIG. 13, the output surfaces shown in FIG. 17 and using the data flow shown in FIG. 14.

The flow chart shown in FIG. 18 is similar to the flow chart shown in FIG. 11. However, in the first step, instead of the GPU 2 generating a single input surface having a lower fidelity peripheral region (as is the case in the embodiment described with reference to FIG. 11), the GPU 2 generates a high fidelity input frame 61 and a lower fidelity version 62 of the input frame which are written to a frame buffer in the off-chip memory 3 (step 301, FIG. 18).

After this, the steps of the embodiment described with reference to FIG. 18 are fairly similar to those shown in FIG. 11, i.e. the head pose tracking data is read by the GPU 2 (step 302, FIG. 18) and the GPU 2 is initialised to process the first pixel of an output frame 66 (step 303, FIG. 18).

Next, in a variation from the embodiment described with reference to FIG. 11, the GPU 2 determines when the pixel is in a region that will experience lens distortion (i.e. the border (peripheral) region of the output frame 66) (step 304, FIG. 18). When the pixel lies in this peripheral region of the output frame 66 (e.g. the peripheral region 64 of the output frame 63 shown in FIGS. 16*b* and 16*c*), the GPU 2 reads the relevant low fidelity image data for this pixel from the frame buffer of the input frame 50 (step 305, FIG. 18). Alternatively, when the pixel is within the central region (e.g. the central region 65 of the output frame 63 shown in FIGS. 16*b* and 16*c*), the GPU 2 reads the relevant high fidelity image data for this pixel (step 306, FIG. 18).

Once the relevant low or high fidelity image data has been read for the pixel, the same steps are followed as in the embodiment described with reference to FIG. 11, i.e. lens correction processing is performed (step 307, FIG. 18) and the image data for the output frame 66 is written to an output frame buffer (step 308, FIG. 18). Then any further pixels in the output frame 66 are processed (step 309, FIG. 18) following the previously described method (steps 304-308, FIG. 18).

The image data written out for the output frame 66 is then be read by the display controller 5 (step 310, FIG. 18), with the display controller 5 then sending the output frame 66 to the display panel 4 (step 311, FIG. 18).

Once the output frame 66 has been generated (and subsequently displayed), and there are more output frames to be generated before the next input frames 61, 62 are scheduled to be generated (step 312, FIG. 18), the next output frame 67 is generated in the same manner, using the latest available head pose data (steps 302-311, FIG. 18). This process is repeated for each of the output frames 68, 69 to be generated until a new set of input frames are generated (step 313, FIG. 18).

When it is time for the next set of input frames to be generated, the whole process, starting with the GPU 2 generating the new input frames (step 301, FIG. 18), is repeated in order to produce the time-warped output frames for this next set of input frames (steps 302-312, FIG. 18).

It will be appreciated that in an alternative embodiment, the process of selecting output frames from input frames dependent on the position of pixels in the output frame, in order to account for lens distortion (i.e. steps 303-307, FIG. 18), may be performed by the display controller 5 instead of the GPU 2, e.g. in a similar manner to the operation described with reference to the flow chart of FIG. 12.

As will now be described with reference to FIGS. 19 and 20, the selection of the appropriate parts from different fidelity input frames, when generating output frames, may be performed to account for both lens distortion (i.e. the position being viewed in the output frame) and the received head position data (i.e. the parts of the input frame(s) to select). This may be particularly important when the head movement detected is large. (It should be noted that the head movements detected when generating the output frames 66, 67, 68, 69 in FIG. 17 were only small and thus not enough for any of the output frames 66, 67, 68, 69 to be selected from the peripheral region of the input frames 61, 62 shown in FIG. 13.)

Figure 19:
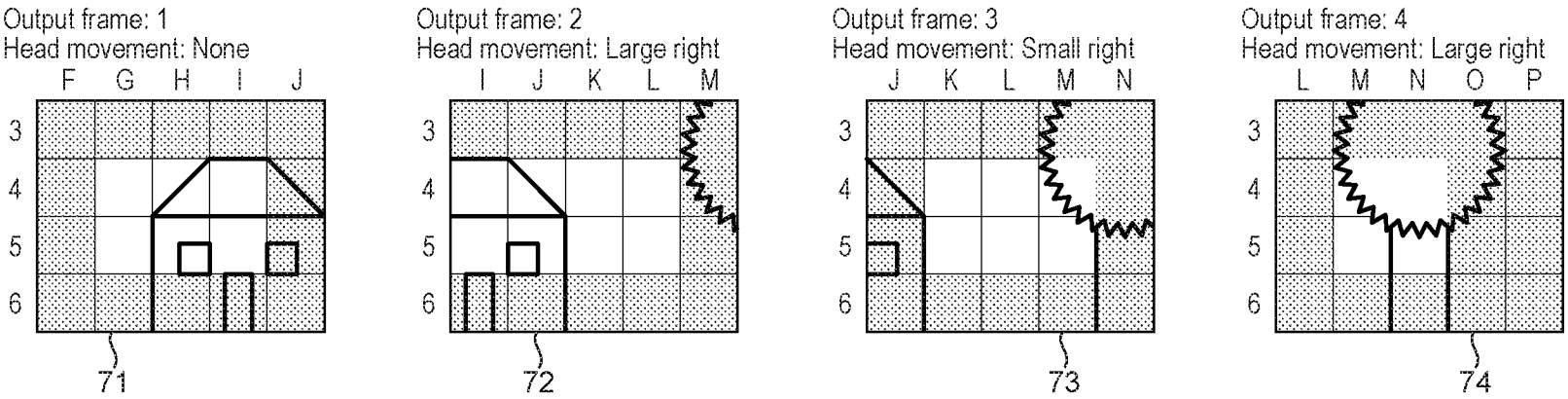
FIG. 19 shows schematically the generation of output surfaces in an embodiment of the technology described herein.

FIG. 19 shows schematically the generation of four time-warped output surfaces 71, 72, 73, 74 from the input surfaces 61, 62 shown in FIG. 13, in an embodiment of the technology described herein. It will be seen that the field of view of these output surfaces 71, 72, 73, 74 (which is based on the received head pose tracking data) is the same as for the output surfaces 45, 46, 47, 48 shown in FIG. 6 and thus the blocks of pixels selected for the output frames 71, 72, 73, 74 are taken from the same respective blocks of the input frames 61, 62.

However, for the output frames 71, 72, 73, 74 of FIG. 19, the blocks for each of the output frames 71, 72, 73, 74 are selected from the two input frames 61, 62 shown in FIG. 13 depending on the position of a pixel in an output frame 71, 72, 73, 74 (to account for lens distortion, e.g. as described with reference to FIGS. 16*a*, 16*b*, 16*c*, 17 and 18) and the position of the corresponding pixel in an input frame 61, 62 (to account for the head movement of a user, i.e. based on the received head pose tracking data).

Thus it will be seen that when the head movement (determined from the received head pose tracking data) at the time of generating an output frame 71, 72, 73, 74 is such that the output frame 71, 72, 73, 74 contains a region that is to be selected from the peripheral region (columns A, B, O and P, and rows 1, 2, 7 and 8) of the input frames 61, 62 shown in FIG. 13, the image data is selected from the lower fidelity input frame 62. In addition, the peripheral region (i.e. the perimeter blocks) of the output frames 71, 72, 73, 74 are selected from the lower fidelity input frame 62 (even when the received head pose tracking data indicates that they would otherwise not have been selected from the lower fidelity input frame 62). Otherwise, i.e. for blocks in the central region of the output frames 71, 72, 73, 74 and that, based on the head pose tracking data, are not to be selected from the peripheral region of the input frames 61, 62, the image data is selected from the higher fidelity input frame 61.

(In this embodiment the peripheral region of the input frames 61, 62 corresponds to the peripheral region 57 of the input frame 50 shown in FIG. 9, though this does not have to, and in other embodiments will not, be the case.)

Operation of the generation of the output frames 71, 72, 73, 74 shown in FIG. 19 will now be described with reference to FIG. 20. FIG. 20 is a flow chart that shows the operation of the system shown in FIG. 1 when generating the input surfaces shown in FIG. 13, the output surfaces shown in FIG. 19 and using the data flow shown in FIG. 14.

Figure 20:
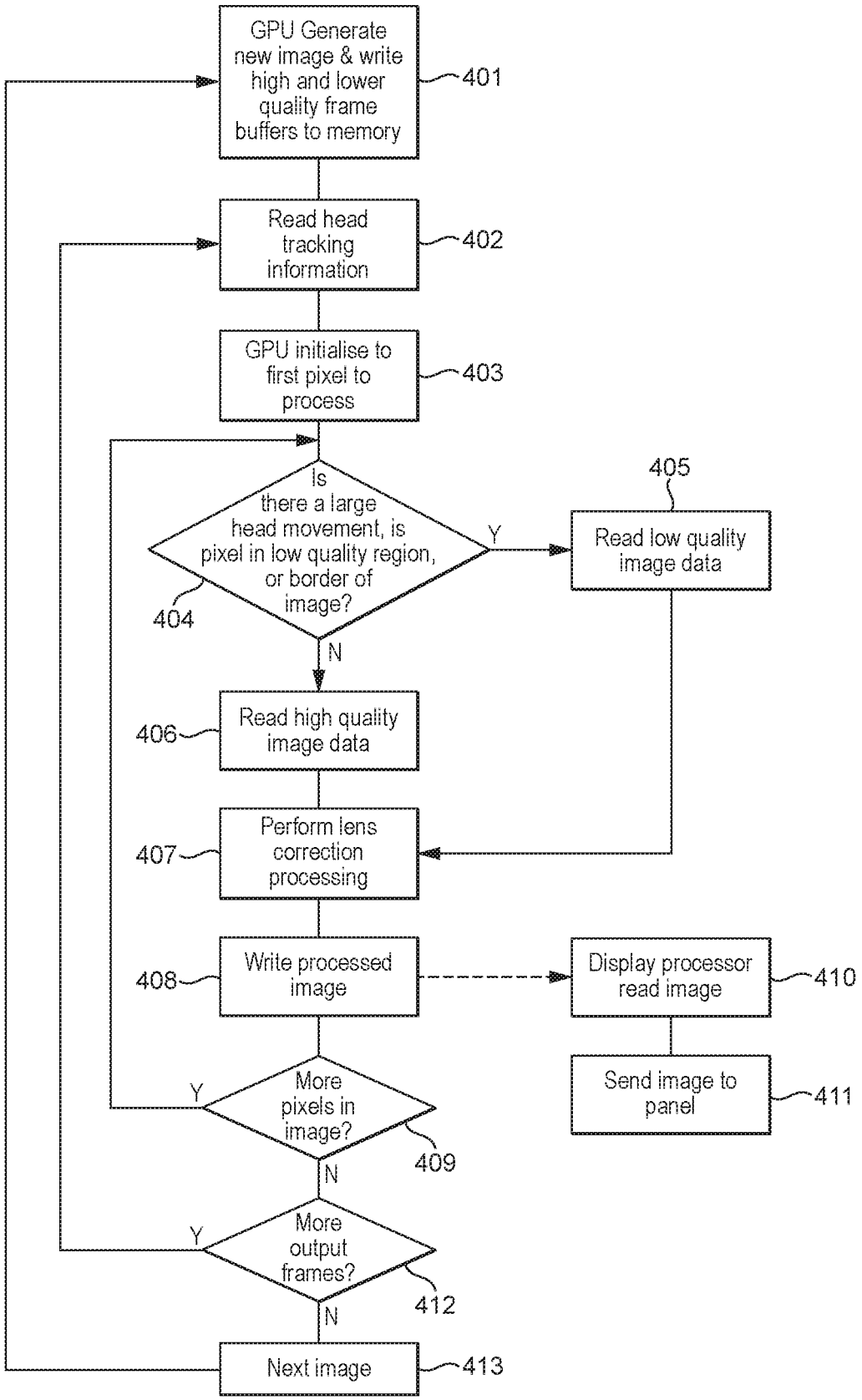
FIG. 20 is a flow chart that shows the operation of the system shown in FIG. 1 when generating the input surfaces shown in FIG. 13, the output surfaces shown in FIG. 19 and using the data flow shown in FIG. 14 in another embodiment of the technology described herein.

Operation of this embodiment is almost identical to that shown in the flow chart of FIG. 18; indeed steps 401-403 and steps 405-413 shown in FIG. 20 are the same as steps 301-303 and 305-313 shown in FIG. 18, with only step 404 being different.

Thus, in this embodiment, to select the relevant parts of the input frames 61, 62 shown in FIG. 13 to form the output frames 71, 72, 73, 74 shown in FIG. 19, the GPU 2 determines, based on the head pose tracking data, for a given pixel in an output frame 71, 72, 73, 74, when the pixel corresponds to location in the peripheral region of the input frames 61, 62 or when the pixel is in a peripheral region of the output frame 71, 72, 73, 74 (i.e. that will experience lens distortion) (step 404, FIG. 20).

If the pixel lies in either (or both) of these regions, the GPU 2 reads the relevant low fidelity image data for this pixel from the frame buffer of the lower fidelity input frame 62 (step 405, FIG. 20). Alternatively, when the pixel is not in either of these regions (i.e. it falls both within the central region of the output frame 71, 72, 73, 74 and (if the head pose tracking data indicates that it falls) within the central region of the input frames 61, 62), the GPU 2 reads the relevant high fidelity image data from the higher fidelity input frame 61 for this pixel (step 406, FIG. 20).

Operation of the process shown in FIG. 20 then continues to generate output surfaces in the manner described with reference to the corresponding steps in FIG. 18.

Again it will be appreciated that in an alternative embodiment, the process of selecting output frames from input frames (i.e. steps 403-407, FIG. 20), may be performed by the display controller 5 instead of the GPU 2, e.g. in a similar manner to the operation described with reference to the flow chart of FIG. 12.

Figure 21:
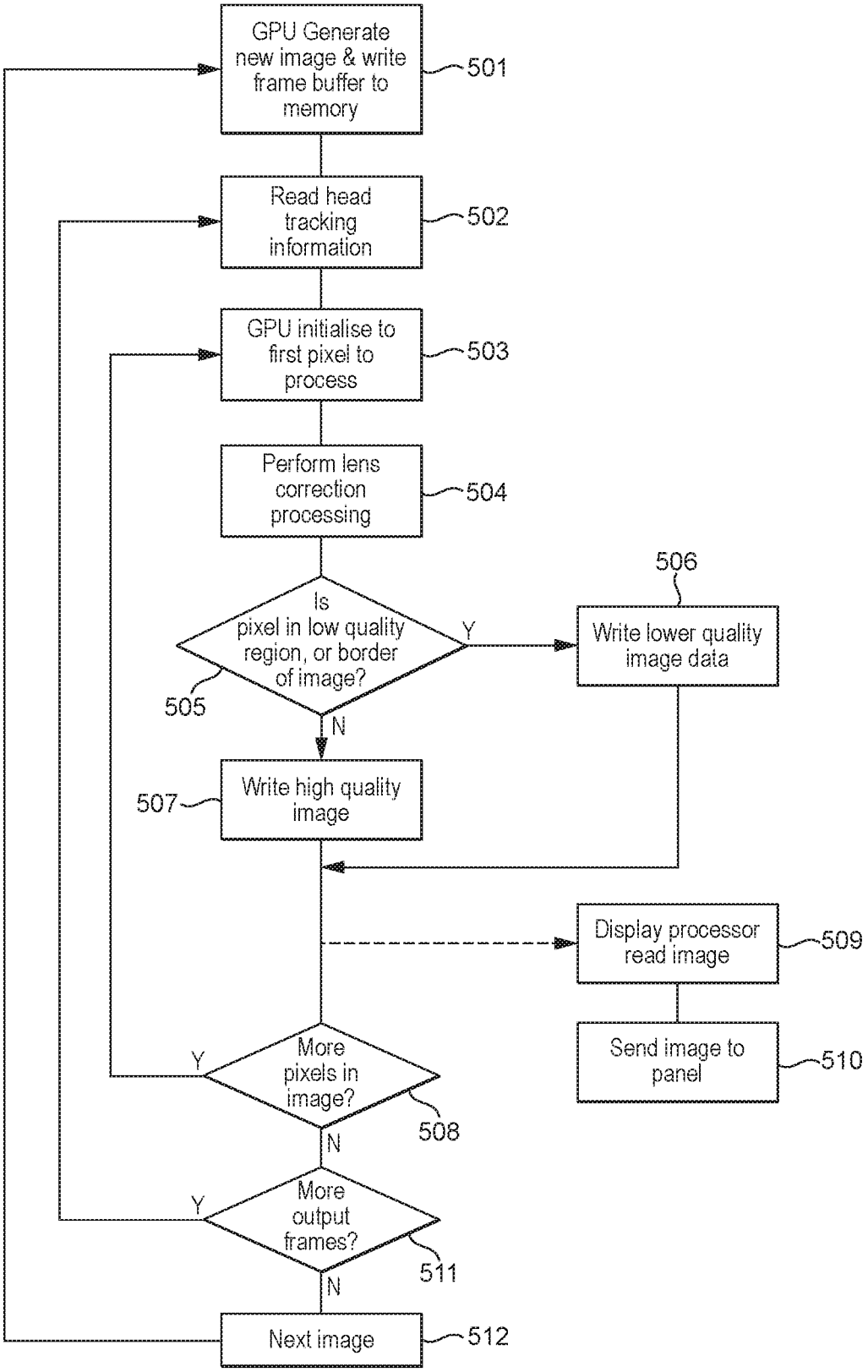
FIG. 21 is a flow chart that shows the operation of the system shown in FIG. 1 when generating the input surface shown in FIG. 5 and the output surfaces shown in FIG. 19 and using the data flow shown in FIG. 10 in another embodiment of the technology described herein.

A further embodiment will now be described with reference to the flow chart of FIG. 21. FIG. 21 is a flow chart that shows the operation of the system shown in FIG. 1 when generating the input surface shown in FIG. 5, the output surfaces 71, 72, 73, 74 shown in FIG. 19 and using the data flow shown in FIG. 10 in another embodiment of the technology described herein.

It should be noted that this embodiment is different to previously described embodiments in that only a single input frame of a uniform fidelity is generated, e.g. the input frame 40 shown in FIG. 5. The fidelity of the image data for the output frame being produced from that input frame is then (selected and) varied, depending on the position of a pixel in the input frame (based on the head pose tracking data) and its corresponding position in the output frame.

Thus, in this embodiment, the GPU 2 first generates a new input frame 40 (as shown in FIG. 5) having a high fidelity over its whole area, and writes this input frame 40 to a frame buffer (step 501, FIG. 21).

The head tracking information is then read by the GPU 2 (step 502, FIG. 21) and based on this, the GPU 2 determines the first pixel of the first output frame 71 to process (step 503, FIG. 21).

Another difference from previous embodiments is that at this stage in the processing, lens correction processing is performed (step 504, FIG. 21), before the GPU 2 determines how to compose the output frame 71, 72, 73, 74.

After the lens correction processing has been performed, the GPU determines, for the pixel in an output frame 71, 72, 73, 74, when the pixel corresponds to location in the peripheral region of the input frame 40 (based on the head pose tracking data) and/or when the pixel is in a peripheral region of the output frame 71, 72, 73, 74 (i.e. that will experience lens distortion) (step 505, FIG. 21). When the pixel lies in either (or both) of these regions, the GPU 2 selects the low fidelity image data from the input frame to write out for this pixel (step 506, FIG. 21).

When the pixel corresponds to a location in the peripheral region of the output frame 71, 72, 73, 74 or to a peripheral region of the input frame 40, the GPU 2, when writing out the image data for the pixel, compresses the high fidelity image data from the input frame 40 and writes out corresponding low fidelity image data to be used in this region of the output frame 71, 72, 73, 74 (step 506, FIG. 21).

Alternatively, when the pixel is not in either of these regions (i.e. it falls both within the central region of the output frame 71, 72, 73, 74 and within the central region of the input frame 50), the GPU 2 writes out the relevant high fidelity image data from the input frame 40 for this pixel (step 507, FIG. 20).

As in previous embodiments, once all the pixels in the output frame 71, 72, 73, 74 have been processed (step 508, FIG. 21), the display controller 5 then reads the image (step 509, FIG. 21) and sends it to the display 4 (step 510, FIG. 21). The process is then repeated for further output frames 71, 72, 73, 74 (step 511, FIG. 21) and further input frames 40 in the sequence (step 512, FIG. 21).

It will be seen from the above that in at least some embodiments, the technology described herein comprises a method of and a data processing system for providing an output surface for display in which the output surface is selected from part(s) of one or more input surfaces. The Applicants have appreciated that by generating either the edges of an input surface or a version of the input surface at a lower fidelity for use when composing an output surface, it may be possible (e.g. when a large head movement in a small space of time has been detected) to display a lower quality version of parts of the input surface, e.g. around the edges of the output surface.

This helps to reduce the memory bandwidth consumed when producing output surfaces for display owing to the reduced memory load from the lower quality version of parts of the input surface, e.g. when reading, time-warping and writing out the input and output surfaces.

Although the above embodiments have described the generation and display of a single sequence of output surfaces for display, it will be appreciated that a display may be configured to display separate output surfaces to the left and right eyes, e.g. to create a 3D effect. Thus the generation of output surfaces may comprise generating a sequence of "left" and "right" output surfaces to be displayed to the left and right eyes of the user, respectively. Each pair of "left" and "right" output surfaces may be generated from a common input surface, or from respective "left" and "right" input surfaces, as desired.

The foregoing detailed description has been presented for the purposes of illustration and description. It is not intended to be exhaustive or to limit the technology described herein to the precise form disclosed. Many modifications and variations are possible in light of the above teaching. The described embodiments were chosen in order to best explain the principles of the technology, and its practical application, to thereby enable others skilled in the art to best utilise the technology, in various embodiments and with various modifications as are suited to the particular use contemplated. It is intended that the scope be defined by the claims appended hereto.

What is claimed is:

1. A method of providing an output surface for display, the method comprising:

generating a plurality of input surfaces to be used for providing an output surface for display, wherein the plurality of input surfaces are each generated over a field of view that is greater than the field of view of the output surface, wherein the field of view over which the plurality of input surfaces are each generated comprises a common field of view, and wherein the step of generating the plurality of input surfaces comprises:

generating, over at least the common field of view, a higher fidelity input surface and one or more lower fidelity input surfaces at a lower fidelity than the fidelity at which the higher fidelity input surface is generated;

wherein the step of generating the higher fidelity input surface comprises:

generating, over at least the common field of view, an initial input surface comprising image data and compressing image data of the initial input surface over at least the common field of view to derive the higher fidelity input surface; and wherein the step of generating the one or more lower fidelity input surfaces comprises:

compressing image data of the initial input surface over at least the common field of view to derive the one or more lower fidelity input surfaces; and selecting part of at least one of the plurality of generated input surfaces based on received view orientation data to provide the output surface for display and based on a lens distortion from a lens or lenses that an output surface will be viewed through to provide the output surface for display.

2. The method as claimed in claim 1, the method comprising generating the plurality of input surfaces based on received view orientation data.

3. The method as claimed in claim 1, the method comprising compressing the whole of the initial input surface when writing out a compressed version of the whole of the initial input surface, to write out the one or more lower fidelity input surfaces.

4. The method as claimed in claim 1, the method comprising determining, using the received view orientation data, for a data element position in an output surface that is to be output for display, a corresponding position in the plurality of input surfaces; and sampling the data at the determined corresponding position in one of the plurality of input surfaces to provide data for use at the data element position in the output surface.

5. The method as claimed in claim 1, the method comprising, for a data element position in an output surface, sampling the data at the corresponding position in one of the one or more lower fidelity input surfaces when the corresponding position lies in the peripheral region of the plurality of input surfaces; and sampling the data at the corresponding position in the higher fidelity input surface when the corresponding position lies in the central region of the plurality of input surfaces.

6. The method as claimed in claim 1, the method comprising determining, for data element positions in the peripheral region of an output surface, corresponding positions in one or more of the one or more lower fidelity input surfaces; and sampling the data at the determined corresponding positions in one or more of the one or more lower fidelity input surfaces to provide data for use at the data element positions in the peripheral region of the output surface.

7. The method as claimed in claim 1, wherein the step of selecting part of at least one of the plurality of generated input surfaces comprises:

selecting parts from two or more of the plurality of input surfaces to form the output surface for display, wherein the two or more of the plurality of input surfaces comprise one of the one or more lower fidelity input surfaces.

8. The method as claimed in claim 1, wherein the image data of the initial input surface is compressed to derive the one or more lower fidelity input surfaces using a more lossy compression than a lossless compression or a lossy compression that is used to compress the image data of the initial input surface when deriving the higher fidelity input surface.

9. A data processing system for providing an output surface for display, the data processing system comprising:

rendering circuitry capable of generating a plurality of input surfaces to be used for providing an output surface for display, wherein the plurality of input surfaces are each generated over a field of view that is greater than the field of view of the output surface, wherein the field of view over which the plurality of input surfaces are each generated comprises a common field of view, and wherein the rendering circuitry is capable of:

generating, over at least the common field of view, a higher fidelity input surface and one or more lower fidelity input surfaces at a lower fidelity than the fidelity at which the higher fidelity input surface is generated;

wherein the rendering circuitry is capable of generating the higher fidelity input surface by:

generating, over at least the common field of view, an initial input surface comprising image data; and wherein the data processing system further comprises compression circuitry capable of:

compressing image data of the initial input surface over at least the common field of view to derive the higher fidelity input surface; and compressing image data of the initial input surface over at least the common field of view to derive the one or more lower fidelity input surfaces; and display composition circuitry capable of selecting part of at least one of the plurality of generated input surfaces based on received view orientation data to provide the output surface for display and based on a lens distortion from a lens or lenses that an output surface will be viewed through to provide the output surface for display.

10. The data processing system as claimed in claim 9, wherein the rendering circuitry is capable of generating the plurality of input surfaces based on received view orientation data.

11. The data processing system as claimed in claim 9, wherein the data processing system further comprises compression circuitry capable of:

compressing the whole of the initial input surface when writing out a compressed version of the whole of the initial input surface, to write out the one or more lower fidelity input surfaces.

12. The data processing system as claimed in claim 9, wherein the display composition circuitry is capable of:

determining, using the received view orientation data, for a data element position in an output surface that is to be output for display, a corresponding position in the plurality of input surfaces; and sampling the data at the determined corresponding position in one of the plurality of input surfaces to provide data for use at the data element position in the output surface.

13. The data processing system as claimed in claim 9, wherein the display composition circuitry is capable of:

sampling, for a data element position in an output surface, the data at the corresponding position in one of the one or more lower fidelity input surfaces when the corresponding position lies in the peripheral region of the plurality of input surfaces; and sampling, for a data element position in an output surface, the data at the corresponding position in the higher fidelity input surface when the corresponding position lies in the central region of the plurality of input surfaces.

14. The data processing system as claimed in claim 9, wherein the display composition circuitry is capable of:

determining, for data element positions in the peripheral region of an output surface, corresponding positions in one or more of the one or more lower fidelity input surfaces; and sampling the data at the determined corresponding positions in one or more of the one or more lower fidelity input surfaces to provide data for use at the data element positions in the peripheral region of the output surface.

15. The data processing system as claimed in claim 9, wherein the display composition circuitry is capable of:

selecting parts from two or more of the plurality of input surfaces to form the output surface for display, wherein the two or more of the plurality of input surfaces comprise one of the one or more lower fidelity input surfaces.

16. The data processing system as claimed in claim 9, wherein the compression circuitry is capable of compressing the image data of the initial input surface to derive the higher fidelity input surface using a more lossy compression than a lossless compression or a lossy compression that is used to compress the image data of the initial input surface when deriving the higher fidelity input surface.

17. A non-transitory computer readable storage medium storing computer software code which when executing on a data processing system performs a method of providing an output surface for display, the method comprising:

generating a plurality of input surfaces to be used for providing an output surface for display, wherein the plurality of input surfaces are each generated over a field of view that is greater than the field of view of the output surface, wherein the field of view over which the plurality of input surfaces are each generated comprises a common field of view, and wherein the step of generating the plurality of input surfaces comprises:

generating, over at least the common field of view, a higher fidelity input surface and one or more lower fidelity input surfaces at a lower fidelity than the fidelity at which the higher fidelity input surface is generated;

wherein the step of generating the higher fidelity input surface comprises:

generating, over at least the common field of view, an initial input surface comprising image data and compressing image data of the initial input surface over at least the common field of view to derive the higher fidelity input surface; and wherein the step of generating the one or more lower fidelity input surfaces comprises:

compressing image data of the initial input surface over at least the common field of view to derive the one or more lower fidelity input surfaces; and selecting part of at least one of the plurality of generated input surfaces based on received view orientation data to provide the output surface for display and based on a lens distortion from a lens or lenses that an output surface will be viewed through to provide the output surface for display.

* * * * *